US007168140B2

(12) United States Patent
McKee et al.

(10) Patent No.: US 7,168,140 B2
(45) Date of Patent: Jan. 30, 2007

(54) FLAME RESISTANT FABRICS WITH IMPROVED AESTHETICS AND COMFORT, AND METHOD OF MAKING SAME

(75) Inventors: Paul A. McKee, Spartanburg, SC (US); Joseph B. Glenn, Belton, SC (US); Mathias Richardson, Pendleton, SC (US); Nathan B. Emery, Spartanburg, SC (US); Roy P. DeMott, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 118 days.

(21) Appl. No.: 10/214,954

(22) Filed: Aug. 8, 2002

(65) Prior Publication Data

US 2004/0029473 A1 Feb. 12, 2004

(51) Int. Cl.
*D06B 1/02* (2006.01)

(52) U.S. Cl. ..... 28/167; 28/104; 28/169

(58) Field of Classification Search ..... 28/167, 28/162, 104, 105, 160, 163, 165, 169; 26/29 R, 26/30; 8/115.51, 115.6, 147; 442/301, 302, 442/240, 242, 119, 118, 93
See application file for complete search history.

(56) References Cited

U.S. PATENT DOCUMENTS

| | | | | |
|---|---|---|---|---|
| 2,241,222 A | | 5/1941 | Sonnino | |
| 4,109,038 A | * | 8/1978 | Hayashi et al. | 428/91 |
| 4,145,467 A | * | 3/1979 | Malik | 26/29 R |
| 4,146,663 A | * | 3/1979 | Ikeda et al. | 28/162 |
| 4,159,618 A | | 7/1979 | Sokaris | 57/251 |
| 4,190,695 A | | 2/1980 | Niederhauser | |
| 4,303,706 A | * | 12/1981 | Minemura et al. | 28/162 |
| 4,384,018 A | * | 5/1983 | Caswell et al. | 428/95 |
| 4,454,189 A | | 6/1984 | Fukata | |
| 4,497,095 A | | 2/1985 | Minemura et al. | |
| 4,499,637 A | | 2/1985 | Greenway | |
| 4,670,327 A | | 6/1987 | Weber | 442/200 |
| 4,750,443 A | | 6/1988 | Blaustein et al. | |
| 4,794,037 A | | 12/1988 | Hosoda et al. | |
| 4,920,000 A | | 4/1990 | Green | |
| 4,967,456 A | | 11/1990 | Sternlieb et al. | |
| 4,995,151 A | | 2/1991 | Siegel et al. | |
| 4,996,099 A | | 2/1991 | Cooke et al. | 442/4 |
| 5,033,262 A | | 7/1991 | Montgomery et al. | 57/5 |
| 5,080,952 A | | 1/1992 | Willbanks | |

(Continued)

OTHER PUBLICATIONS

DuPont Advanced Fibers Systems, DuPont Internet site, Jun. 28, 2002; www.dupont.com/nomex/.

*Primary Examiner*—Amy B. Vanatta
(74) *Attorney, Agent, or Firm*—Terry T. Moyer; Sara M. Current; Cheryl J. Brickey

(57) ABSTRACT

Fabrics having improved aesthetic characteristics in addition to good FR characteristics and strength are described, as well as a method for making the fabrics. The fabrics are made by subjecting a fabric containing inherently flame resistant fibers to a fluid treatment process such that a fabric with good comfort and aesthetic characteristics is formed. In one form of the invention, the fabric comprises plied yarns, and the fluid treatment process serves to separate the plies from each other. The fabrics have a soft hand, good protective characteristics, good strength and durability, as well as good wicking and soil release characteristics.

13 Claims, 6 Drawing Sheets

U.S. PATENT DOCUMENTS 5,136,761 A 8/1992 Sternlieb et al.
5,142,753 A 9/1992 Bolliand et al.
5,223,334 A 6/1993 Green
5,229,184 A 7/1993 Campbell et al.
5,337,460 A 8/1994 Cockfield et al.
5,348,796 A 9/1994 Ichibori et al.
5,468,545 A 11/1995 Fleming et al.
5,480,458 A 1/1996 Fleming et al.
5,506,042 A 4/1996 Ichibori et al.
5,527,597 A 6/1996 Stanhope et al.
5,632,072 A 5/1997 Simon et al.
5,725,951 A * 3/1998 Schuette et al. ..... 8/115.6
5,759,207 A 6/1998 Green
5,766,746 A 6/1998 Kampl et al.
5,806,155 A 9/1998 Malaney et al.
6,055,711 A * 5/2000 Weil et al. ..... 28/151
6,287,686 B1 9/2001 Huang et al.
6,296,023 B1 10/2001 Gehrhardt et al.
6,358,608 B1 3/2002 Hanyon et al.
6,410,140 B1 6/2002 Land et al.
6,770,581 B1 * 8/2004 DeMott et al. ..... 442/93
6,787,228 B2 9/2004 Campbell et al. ..... 428/365
2001/0008823 A1 7/2001 Ghorashi
2001/0009832 A1 7/2001 Shaffer et al.
2001/0052193 A1 12/2001 Payet et al.
2002/0124544 A1 9/2002 Land et al.
2002/0155773 A1 10/2002 Maini
2003/0170419 A1 * 9/2003 Emery et al. ..... 28/104
2005/0118918 A1 * 6/2005 Schafer et al. ..... 28/104

* cited by examiner

FLAME RESISTANT FABRICS WITH IMPROVED AESTHETICS AND COMFORT, AND METHOD OF MAKING SAME

BACKGROUND OF THE INVENTION

A variety of occupations require workers to come into close contact with hot equipment, hot substances open flames, and electric arcs and the like. For example, oil refinery, petro chemical workers, electricians, military personnel, etc. typically operate in such environments. In order to minimize their risk of injury from the hot elements, such workers typically wear flame resistant apparel.

Flame resistant garments are generally made from flame resistant materials such as those made from aramid fibers (including meta-aramids and para-aramids), melamine fibers, or those treated with flame resistant "FR" chemistries. Prior protective garments have focused strictly on flame resistant protection and durability, since the garments must provide good protection to the wearer, and must withstand hazardous environments. In addition, because many garments are often laundered under industrial wash conditions, they must be capable of withstanding a number of such industrial launderings in order to have an acceptable useful life. For example, it is generally considered by the purchasers of these garments that the garments must last through a minimum of 125 industrial launderings. Therefore, the prior garments, which have tended to perform relatively well from the standpoint of protection and durability, have been extremely deficient in aesthetic characteristics such as wearer comfort. For example, they are known to be stiff and to have a harsh handle, and they are generally considered to be hot and uncomfortable to the wearers. Not only is the discomfort typically associated with these garments a source of displeasure to the wearers, but it may discourage them from wearing the equipment that would optimize their protection, thereby jeopardizing their safety. Furthermore, these garments are typically so uncomfortable as to require an undergarment of some sort to protect the wearer's skin, which can be undesirable when the garment is to be worn in hot environments.

There are two general types of FR apparel fabrics currently in the market. The first category is that of inherently flame resistant fibers (such as aramids, melamines, etc.) and the second category achieves flame resistance primarily through the subsequent application of chemistry to the fiber. Fabrics of inherently FR fibers are generally considered to provide greater durability, while chemically-treated fabrics (such as FR cotton) are often considered to provide a lesser degree of durability but at a lesser degree of discomfort to the wearer.

Past attempts to improve the comfort of FR garments have generally been directed to the garment construction, e.g. through the provision of garment vents and the like. As will be appreciated by those of ordinary skill in the art, the garment construction modifications made to enhance comfort can have a negative effect on wearer protection.

Therefore, a need exists for fabrics and garments that provide a good degree of FR protection to users, while providing a greater degree of user comfort and improved aesthetic characteristics. In addition, a need exists for a method of enhancing the aesthetic characteristics of FR fabrics and garments.

SUMMARY

With the foregoing in mind, it is therefore an object of the invention to provide flame resistant fabrics having improved wearer comfort at comparable levels of FR protection and strength to conventional FR fabrics.

It is also an object of the invention to provide FR fabrics having improved aesthetics relative to commercially-available FR fabrics, and in particular, relative to commercially-available fabrics made from inherently FR fibers.

It is also an object of the invention to provide a method for enhancing the comfort of FR fabrics, and for manufacturing FR fabrics having good comfort and aesthetic characteristics in combination with good strength and durability.

It is a further object of the invention to provide an FR fabric having improved strength and moisture absorption with improved cleanability and a reduced tendency for soil redeposition.

The general predictors of how comfortable a fabric will be to wear are the mechanical and surface properties of the fabric, the freedom of movement it affords a wearer (e.g. by draping well rather than being stiff), how well it manages moisture, and its air permeability. In addition, how comfortable a wearer will perceive a garment to be will also depend largely upon which part of the wearer's body the garment is worn and the environment (e.g. hot or cold, humid or dry, etc.) in which it is worn.

The present invention is directed to flame resistant fabrics that provide good protection to the wearer from short exposure open flame, and/or electric arc, while also providing enhanced aesthetics. In particular, the fabrics of the invention have superior hand, physical strength, durability, moisture transport, and soil release, and are more comfortable to the wearer than existing fabrics having comparable levels of FR protection.

In a preferred form of the invention, the fabric is a woven fabric having a weight of about 2 to about 12 oz/sq yard, and more preferably about 4 to about 8 oz/sq yard. In particular, fabrics in these weight ranges are particularly good in apparel type applications. The fabric can be of any desired weave construction, including but not limited to plain weave, twill weave (e.g. 2×1, 2×2, 3×1, etc.), basket weave, ripstop, and oxford weave.

The fabrics of the invention desirably comprise inherently flame resistant fibers ("FR fibers"). In a preferred form of the invention, the fabric is made predominately from (e.g. at least about 65%), or substantially entirely from, FR fibers. It has been found that fabric blends including about 90% to 95% FR fibers perform well. Where the fabric is made substantially entirely from FR fibers, it may also include minor amounts of additional fibers to enhance certain characteristics of the fabric (e.g. physical, aesthetic, and/or performance characteristics such as, but not limited to strength, static dissipation, abrasion resistance, etc. without adversely impacting FR resistance to a substantial extent. Preferably, at least some of the FR fibers are provided in staple form and even more preferably substantially all of the FR fibers are provided in staple fiber form. To this end, it has been found to be desirable to manufacture the fabric at least partially and preferably substantially entirely, from spun yarns. In particular, where the fabric is a woven fabric, it has been found to be desirable to include spun yarns in at least the fabric warp.

The FR fibers can be of any commercially available variety within the scope of the invention, but are desirably selected from the group consisting of aramid fibers, meta-aramids, para-aramids, fluoropolymers and copolymers thereof, chloropolymers, polybenzimidazole, polyimides, polyamideimides, partially oxidized polyacrylonitriles, novoloids, poly(p-phenylene benzobisoazoles), poly)p-phenylene benzothiazoles), polyphenylene sulfides, flame retardant viscose rayons, polyvinyl chloride homopolymers and copolymers thereof, polyetheretherketones, polyketones, polyetherimides, polylactides, melamine fibers, or combinations thereof with other FR fibers or fibers that are not inherently flame resistant. In many instances, commercially-available spun yarns made from inherently FR fibers include minor quantities of other types of fibers such as Kevlar® brand fiber available from DuPont of Wilmington, Del., nylon, P-140 nylon with carbon core from DuPont, or the like, to enhance a fabric's strength, durability, ability to be processed in conventional textile equipment, etc. For example, a preferred fabric of the invention is made from Nomex® IIIA yarns, which contain approximately 95% aramid fiber, and 5% other fibers (Kevlar® aramid and P-140 nylon/carbon), and are available from I.E. DuPont de Nemours of Wilmington, Del. Examples of some other commercially available FR fibers are those sold under the tradenames Kermel and Basofil, available from Rhodia of Colmar, France, and McKinnon-Land of Charlotte, N.C., respectfully.

The fabric of the invention is made by processing the fabric comprising inherently FR fibers with a fluid process designed to raise loops of fibers outwardly from the fabric surface, and form a plurality of fiber tangles that are primarily composed of fibers that are substantially intact and undamaged. Where the fabric comprises plied yarns, the fluid treatment process also desirably separates at least a portion of the plies from each other, detwists them, and causes fibers from adjacent plies to become entangled with each other.

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The fabric of the invention desirably comprises inherently flame resistant fibers ("FR fibers"). In a preferred form of the invention, the fabric includes at least about 65% FR fibers, more preferably at least about 90% FR fibers, and even more preferably, at least about 95% FR fibers. Preferably, at least some of the FR fibers are provided in staple form and even more preferably, substantially all of the FR fibers are provided in the form of spun yarns. As will be appreciated by those of ordinary skill in the art, spun yarns can be made by a variety of production methods, including but not limited to open end spinning, air jet spinning, vortex spinning, ring spinning and the like.

In a preferred form of the invention, the fabric is made substantially entirely from spun yarns. Also in a preferred form of the invention, the yarns are formed of plural plies. Preferably, each of the plies comprises FR staple fibers. Where the fabric of the invention is in the form of a woven fabric, it is particularly preferred that plied spun yarns are provided in at least the fabric warp.

In a preferred form of the invention, the fabric is a woven fabric having a weight of about 2 to about 12 oz/sq yard, and more preferably about 4 to about 8 oz/sq yard. Where the fabric is to be used in the manufacture of industrial clothing such as pants, shirts and overalls, it has been found that fabrics having a weight of about 5.5–6.5 oz/sq yd, and more preferably about 5.8–6.2 oz/sq yard perform well. For example, a fabric having an approximate weight of about 6 oz/sq yd would perform well as an industrial bottom weight fabric.

The fabric is preferably a woven fabric, and can be of any desired weave construction, including but not limited to plain weave, twill weave (e.g. 2×1, 2×2, 3×1, etc.), basket weave, oxford weave, satin weave, and jacquard weave. The fabrics can be woven according to conventional weaving processes.

The fabric desirably has first and second surfaces, with at least one surface having a plurality of fiber tangles that are composed primarily of fibers that are substantially intact and undamaged. When the fabric is formed from plied yarns, the individual plies are desirably at least partially separated from each other and individual fibers from different plies are entangled with each other.

Figure 1:
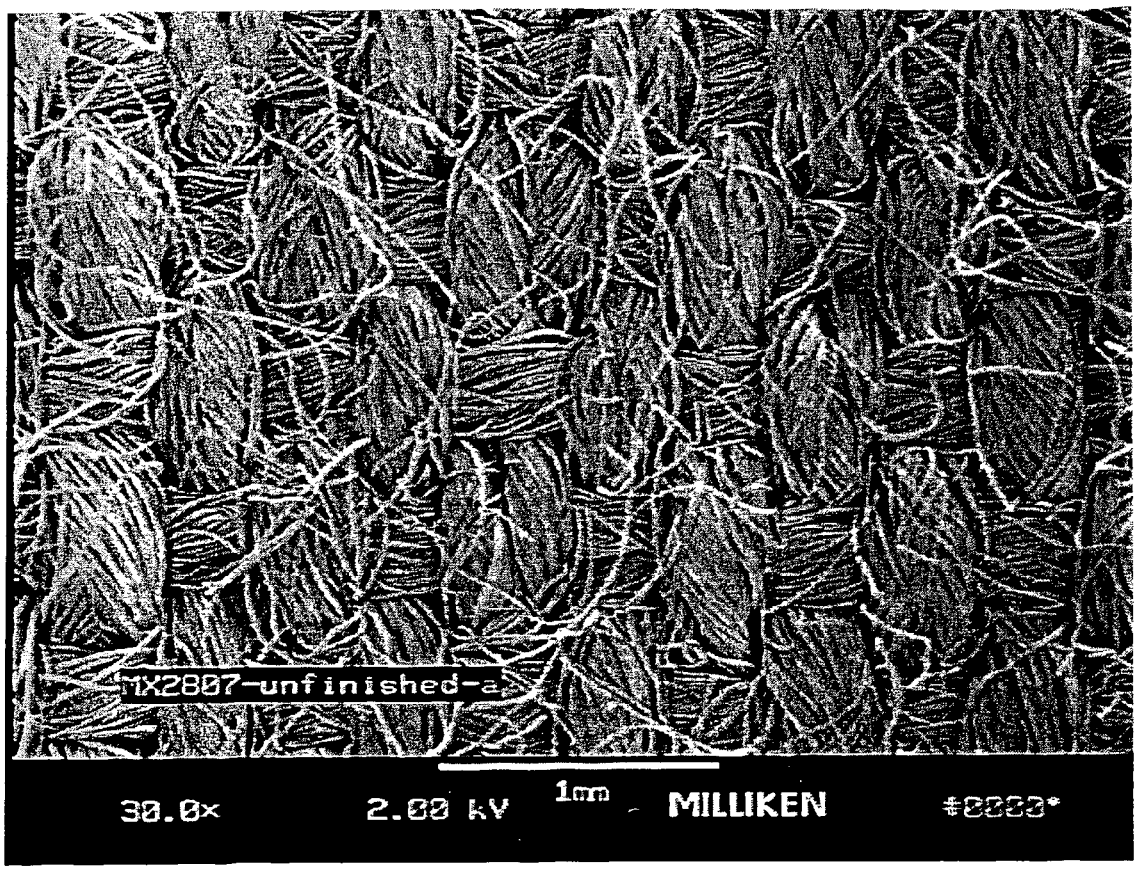
FIG. 1 is a photomicrograph (30× magnification) of the unenhanced fabric of Example A.
Figure 2:
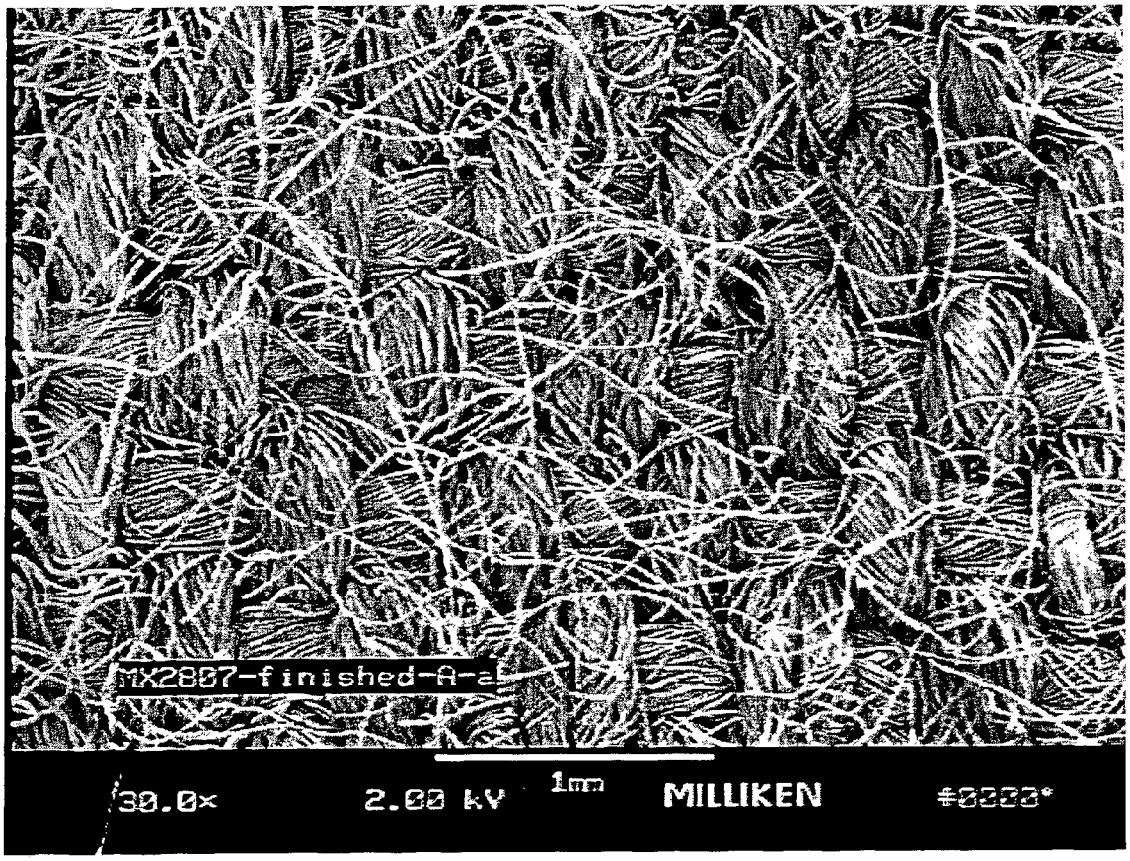
FIG. 2 is a photomicrograph (30× magnification) of the enhanced fabric of Example B.
Figure 3:
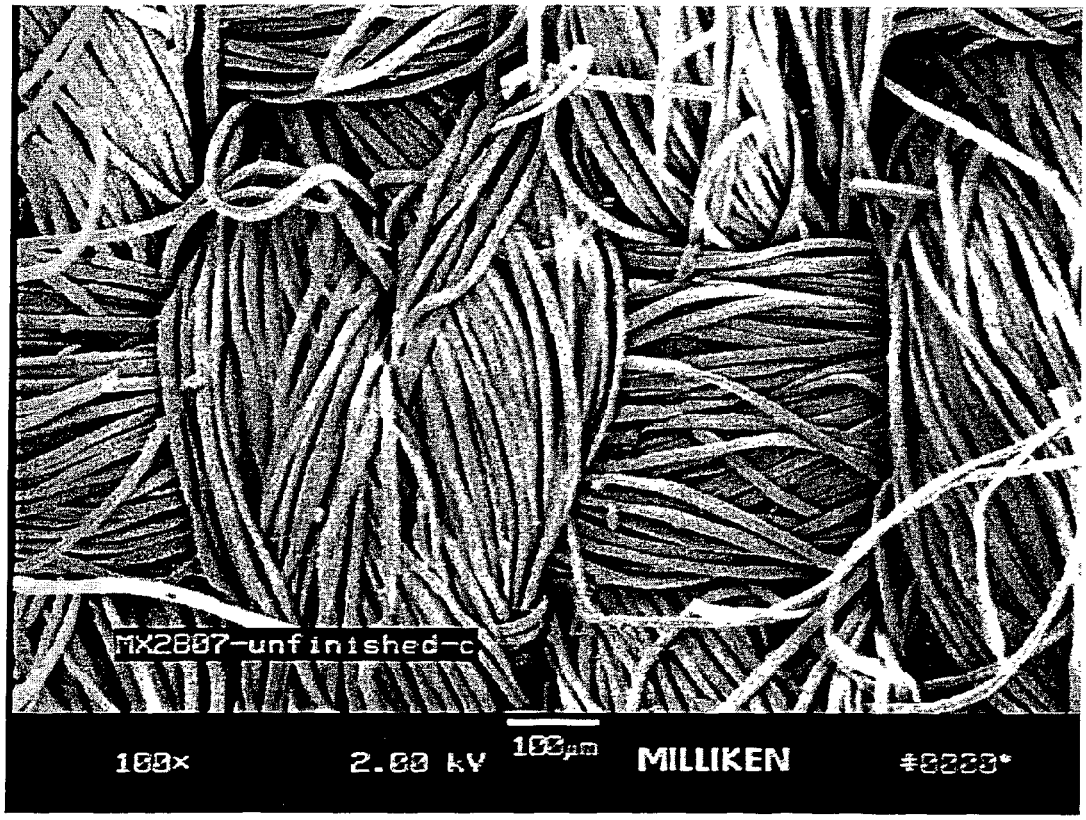
FIG. 3 is a photomicrograph (100× magnification) of the unenhanced fabric according to Example A.
Figure 4:
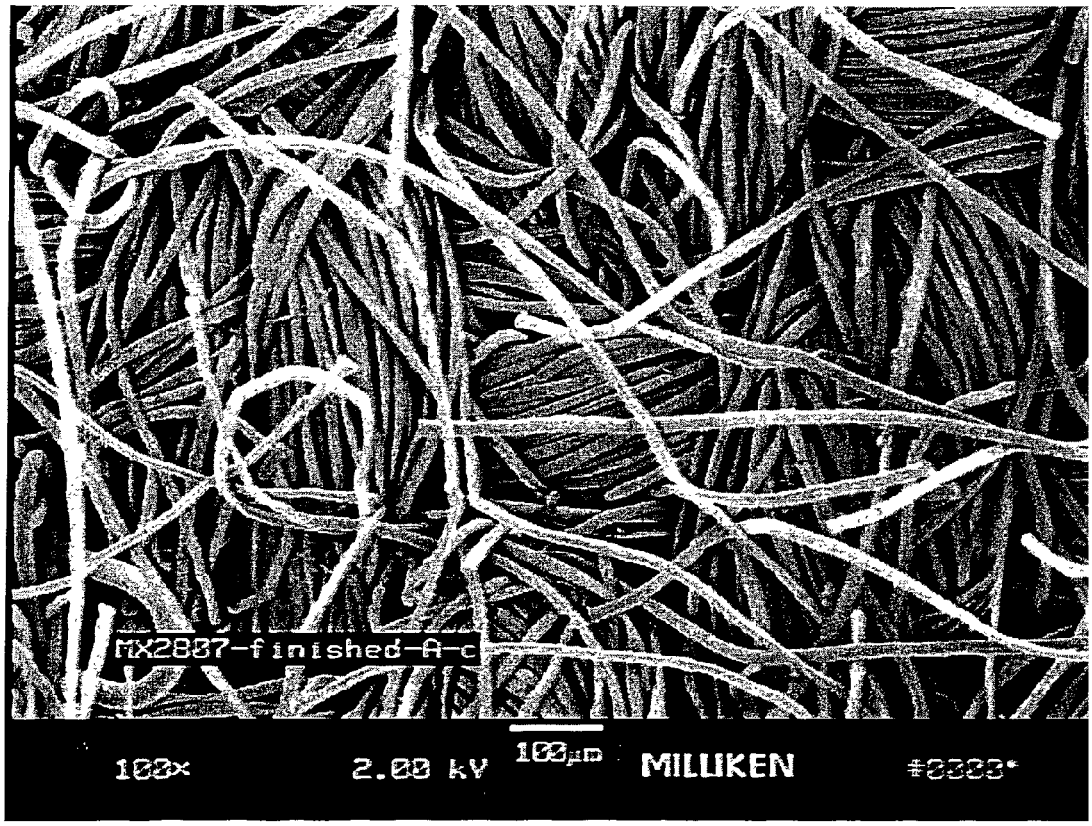
FIG. 4 is a photomicrograh (100× magnification) of the enhanced fabric of Example B below.
Figure 5:
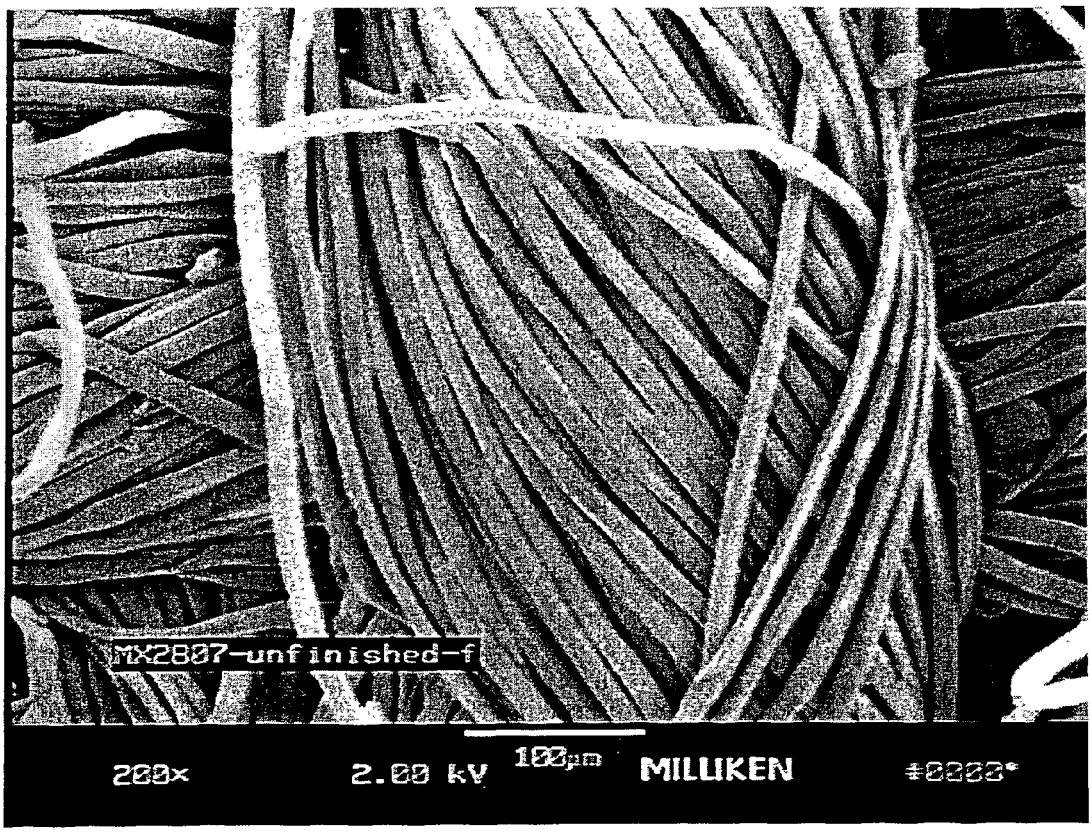
FIG. 5 is a photomicrograph (200× magnification) of the unenhanced fabric of Example A.
Figure 6:
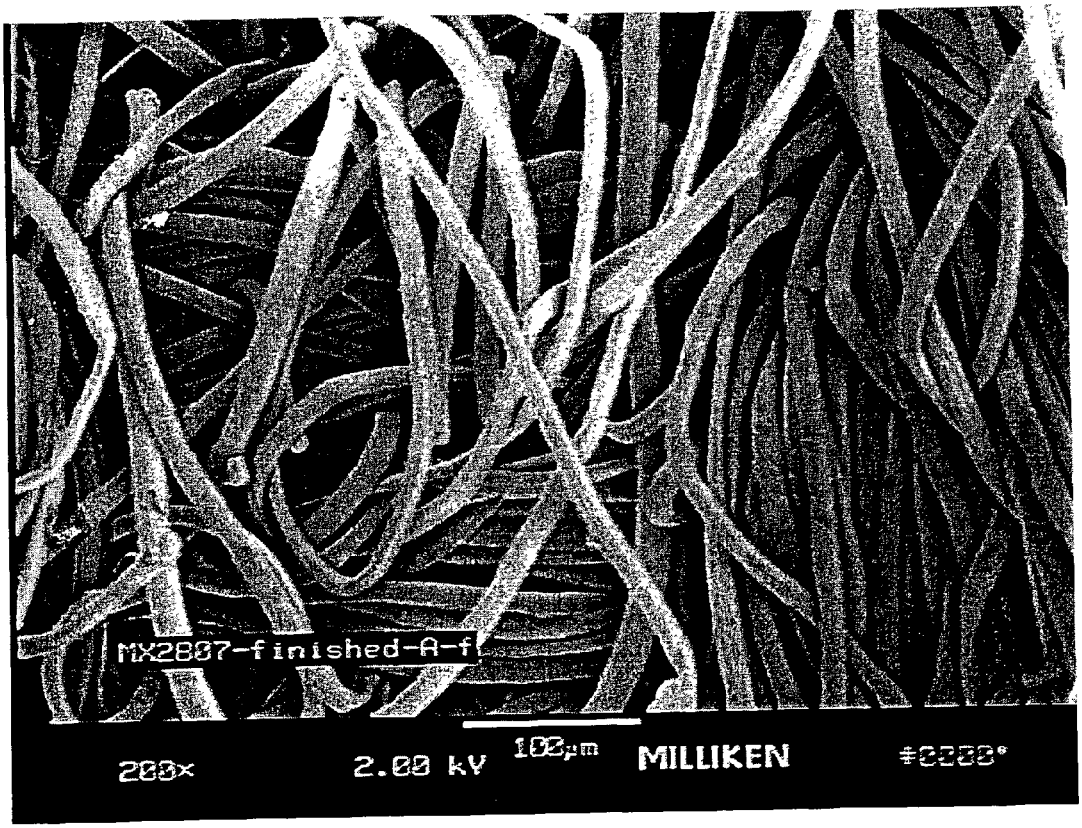
FIG. 6 Is a photomicrograph (200× magnification) of the enhanced fabric of Example B below.

As illustrated in the drawings, FIGS. 1, 3 and 5 are photomicrographs at 30×, 100×, and 200× magnification, while FIGS. 2, 4 and 6 are photomicrographs at the same levels of magnification (i.e 30×, 100× and 200×, respectively) of the fabrics of the invention. As can clearly be seen from the photomicrographs, the fabrics of the invention are characterized by a plurality of fiber tangles or teased loops that are comprised of fibers that are substantially intact and undamaged, as opposed to the unenhanced fabrics which have very little entanglement of the fibers and little surface effect. Also as shown, the plied yarns used in this embodiment of the invention are at least partially separated into their individual components and in some cases, the fibers from the individual components are also entangled with each other. This characteristic was not only unexpected, but it has been found to provide a unique and dramatic improvement in aesthetic and hand characteristics as compared with the untreated fabric, while retaining good fiber strength and FR characteristics as well.

One method of manufacturing the fabrics of the instant invention is as follows: a fabric as described above is woven or obtained. The fabric is then subjected to a high pressure fluid stream that is designed to soften and loft the fabric. One example of a fluid process that may be used is a hydraulic process of the variety described in commonly-assigned co-pending U.S. patent application Ser. No. 09/344,596 to Emery et al, filed Jun. 25, 1999, the disclosure of which is incorporated herein by reference. The type of fabric treatment and treatment parameters were selected to optimize the aesthetic characteristics of the fabric. Where multi-ply yarns are used, the high pressure stream also was surprisingly found to separate the plies from each other and to de-twist the yarns to some extent. It is believed that this lofting and ply separation dramatically enhanced the fabric hand and comfort, without adversely impacting fabric strength. The fabric can be treated on one or both fabric surfaces, depending on the desired end result. Also, if desired, one or more chemistries designed to enhance the fabric characteristics can be applied, either prior or subsequent to the hydraulic processing.

The fabric can be dyed to achieve an aesthetically appealing color, as desired. The dye process can be selected to optimize processing for the particular fiber content of the fabric and color desired. In the instant case, it has been found that using cationic dyes of the variety recommended by dye manufacturers for dyeing Nomex® aramid fibers in a jet dye process at temperatures from about 220 degrees to about 270 degrees F. (and more preferably from about 250–270° F.) achieves a good color shade and fabrics having good colorfastness.

As noted above, chemistries can be applied to the fabric at any stage of the process, including before, during or after dyeing. In this way, additional characteristics such as moisture wicking, soil release, hand improvements, etc. can be obtained via chemical means. For example, it was surprisingly found that by applying an ethoxylated polyamide (traditionally used as a lubricant for nylon) and a high molecular weight ethoxylated polyester (typically used to enhance softness, wicking and stain release), fabrics having soil release and moisture transmission characteristics superior to those of commercially available fabrics were achieved at comparable levels of FR protection. Furthermore, it is believed that this superior soil release will also enhance the FR protection provided by the fabrics during their useful lives, since the fabrics of the invention will more readily release flammable soils such as oil and the like.

The fabrics are then desirably dried in a conventional manner, such as by running them through a heated tenter frame at a temperature of between about 325 and about 425 degrees F.

The fabrics of the invention have superior aesthetic characteristics (e.g. hand), as well as superior durability and performance (as evidenced by the test data below.) In addition, the fabrics had superior performance in the features correlating to enhanced wearer comfort. Furthermore, the fabrics had a unique surface characteristic, heretofore unachieved in FR fabrics.

EXAMPLES

Example A—A fabric was woven from 30/2 100% Nomex IIIA® air-jet spun yarns (95% Aramid, 3% Kevlar®, and 2% Nylon P-140 (from DuPont) with a twist multiple of 14 of the variety available from Pharr Yarns of McAdenville, N.C. in a 1×1 plain weave construction. The fabric was jet dyed in a conventional manner using cationic dyes of the variety conventionally recommended for the dyeing of the Nomex, and acid dyes of the variety commonly used to dye nylon (both of which will be readily appreciated by those of ordinary skill in the art. Dyeing was performed at approximately 266° F. for one hour. The fabric was then passed through a pad containing 1½% Lurotex A-25 ethoxylated polyamide (distributed by BASF of Mount Olive, N.J.) and 1½% Lubril QCX high molecular weight ethoxylated polyester manufactured by Tennessee Eastman (to facilitate stain release and wicking). The fabric was then dried in a conventional manner on a tenter frame at about 410° F. at a speed of approximately 25 yards per minute, after which the fabric was taken up for inspection. The finished product was nominally 68 ends per inch ×44 picks per inch, and was 5.89 oz/sq yd in weight.

Example B—A fabric was woven in the same manner as Example A. However, prior to the jet dyeing step, it was run through a pad containing 1% Lubril QCX, a high molecular weight ethoxylated polyester of the variety designed to promote stain release (1% Lubril QCX from Tennessee Eastman), then the fabric was impacted by water jets on each of its face and back in the manner described in commonly-assigned co-pending U.S. patent application Ser. No. 09/344,596 to Emery et al, filed Jun. 25, 1999. The fabric was pulled through the pad and hydraulically treated at a speed of 30 yards per minute, and hydraulic treatment was performed using 1200 psi of the front side of the fabric and 800 psi on the opposite side of the fabric (manifold exit pressure). The water originated from a linear series of nozzles which were rectangular 0.015 inches wide, (filling direction)×0.010 inches high (warp direction) in shape and were equally spaced along the treatment zone. There were 40 nozzles per inch along the width of the manifold. The fabric traveled over a smooth stainless steel roll that was positioned 0.120 inches from the nozzles. The nozzles were directed downward about five degrees from perpendicular, and the water streams intersected the fabric path as the fabric was moving away from the surface of the roll. The tension in the fabric within the first treatment zone was set at about 45 pounds. In the second treatment zone, the opposite side of the fabric was treated with high pressure water that originated from a similar series of nozzles as described above. In this zone the water pressure was about 800 psig, the gap between the nozzles and the treatment roll was about 0.120 inches, and the nozzles were directed downward about five degrees from perpendicular. As before, the water streams intersected the fabric path as the fabric was moving away from the surface of the roll. The fabric tension between the treatment zones was set at about 85 pounds, and the fabric exit tension was set at about 90 pounds. The fabric was then dried to remove 95% of the moisture. The fabric was then dyed and finished in the same manner as Example A. It was surprisingly found that the hydraulic processing served to distinctly separate the plies of the multi-ply yarns and entangle yarns from different plies, in addition to expanding and opening the interstices of the fabric, and that this particular hydraulic treatment process primarily affected the yarns in the fabric warp.

Example C—A fabric was produced in the same manner as Example B, except the pressures used during hydraulic processing were 1100 on the front side of the fabric and 800 on the back side of the fabric.

Example D—A commercially available 6.39 oz/sq yd plain woven 100% Nomex® IIIA aramid fabric of the variety typically used for coveralls or pants was obtained. It is believed that the fabric was finished with hand builders for added stiffness. The fabric had 26.46/2 MJS yarns (1.67 dpf) in the warp and 27.32/2 MJS yarns (1.76 dpf) in the filling. The fabric had approximately 66 ends per inch (epi) and 47 picks per inch (ppi), and had been dyed a navy color.

Example E is a commercially available 6.00 oz/sq yd plain woven 100% Nomex® IIIA aramid fabric. The fabric had 28.74/2 MJS yarns (1.72 dpf) in the warp and 28.85/2 MJS yarns (1.76 dpf) in the filling. The fabric had approximately 66 epi and 42 ppi, and had been dyed a spruce green color.

Example F is a commercially available 6.05 oz/sq yd plain woven 100% Nomex ® IIIA aramid fabric. The fabric had 27.37/2 MJS yarns (1.71 dpf) in the warp and 28.41 MJS (1.74 dpf) yarns in the filling. The fabric had approximately 65 epi and 44 ppi. The fabric had been dyed a royal blue color.

Example G is a commercially available 6.39 oz/sq yd plain woven 100% Nomex® IIIA aramid fabric of the variety typically used for outer clothing was obtained. It is believed that the fabric was finished with hand builders for added stiffness. The fabric had 26.46/2 MJS yarns (1.67 dpf) in the warp and 27.32/2 MJS yarns (1.76 dpf) in the filling. The fabric had approximately 66 ends per inch (epi) and 47 picks per inch (ppi), and had been dyed a navy blue color.

Example H was another commercially available FR fabric. The fabric was a 7 oz. 3×1 lefthand twill woven 100% cotton FR treated fabric having 92 epi×49 ppi, with 17.82/1 ring spun yarns in the warp and 12.08/1 RS yarns in the filling. The fabric had been dyed a navy blue color. It is believed that the FR treatment was achieved through a conventional ammonia treatment.

Example I was a commercially available 9 oz/sq yd 3×1 lefthand twill woven 100% cotton FR treated fabric. The fabric had 87 ends per inch and 50 picks per inch using 12.44/1 ring spun yarns in the warp and 8.53/1 ring spun yarns in the filling. The fabric had been dyed a khaki color. It is believed that the FR treatment was achieved through a conventional ammonia treatment.

Example J was another commercially available FR fabric. The fabric was a 7 oz. 88% cotton/12% nylon fabric. The fabric had 93 epi x 50 ppi, with 18.12/1 RS yarns in the warp and 11.89/1 RS yarns in the filling. The fabric had been dyed a khaki color. It is believed that the FR treatment was achieved through a conventional ammonia treatment.

Example K was another commercially available FR fabric. The fabric was 9.68 oz. 88% cotton/12% nylon 3×1 twill woven fabric. The fabric had 92 epi x 50 ppi, and 12.56 RS yarns in the warp and 8.58/1 RS yarns in the filling. The fabric had been dyed a navy blue color. It is believed that the FR treatment was achieved through a conventional ammonia treatment.

The fabrics were all subjected to a variety of tests as outlined below. The fabrics were tested in their as-produced form (unless otherwise specified in the test method), after 50 washes, and after 125 washes. All washes were performed in accordance with the Standard Formula Industrial Wash Method described below. The results of the tests are listed in the tables below.

Test Methods

Standard Formula Industrial Wash Method—All washings were performed according to the following wash method: Garments were washed in a conventional industrial washer at 80% capacity for 12 minutes at 140° F., using the low water level and 8.0 oz of Choice chemical, which is commercially from Washing Systems, Inc. of Cincinnati, Ohio. The washing cycle was performed as follows: drop/fill/wash for 3 minutes at 140° F., low level water using 7.5 oz of Choice chemical; drop/fill/rinse for 2 minutes at 140° F., high level water, no chemical; drop/fill/rinse for 2 minutes at 80° F., high level water, no chemical; drop/fill/rinse for 2 minutes at 80° F., high level water, no chemical; drop/fill/wash for 4 minutes at 80° F., low level water using 0.3 oz acid sour; Extract water for 7 minutes at high speed.

Tensile Strength—Tensile strengths in both the warp and filling directions were measured according to ASTM D1682-75. Generally speaking, in a protective product/protective garment end use, relatively high tensile strengths are desired since they positively impact durability. An exemplary industry specification for an industrial garment such as an overall or pant is 150 lbs in the warp and 100 lbs in the filling.

Tear Strength—Tear strengths in both the warp and filling directions were measured according to ASTM D2262-83. Generally speaking, in a protective product/protective garment end use, relatively high tear strengths are considered to be desirable, since they correlate to durability. An exemplary industry specification for an overall or pant garment is a tear strength of 7.5 lbs in the warp direction and 7.5 lbs in the filling direction.

Pilling—Pilling was tested after 30 minutes, 60 minutes, and 90 minutes according to ASTM D3512-82. A higher pilling rating indicates that the fabric has a greater resistance to pilling. A typical industry specification for an industrial garment such as an overall or a pant is 3.5–5 after 60 minutes.

Seam Slippage—Seam slippage was measured in both the warp and filling directions according to ASTM D434-75. Generally speaking, a higher seam slippage will enhance product durability and an exemplary industry specific for a fabric to be used in an industrial garment such as a pant or overall would be 30 lbs in each direction.

Stoll Flat Abrasion—Abrasion resistance was measured according to ASTM D3886-80. The maximum reading that the test will register is 1000.

Stretch—Stretch in each of the warp and filling directions was measured according to ASTM D3107-75.

Fray—Fray was measured in both the warp and filling directions according to the following procedure, and the results recorded. A set of five (5) 4¼" circle specimens of each sample are cut using a punch press machine, and are conditioned for one hour at 65% relative humidity ±5% at 70±5° F. (When cutting the samples, cut no closer to the selvage than 10% (±1%) of the fabric width, and mark the warp direction on each specimen.) A Random Tumble Pilling Machine available from Atlas, Inc. If the cork liner in the pilling apparatus has been used more than 3 times, place a new cork liner into test cylinders of the pilling tester making sure they are fitted properly to give a smooth joint. Put the five specimens from one sample into a single test cylinder. Make sure all specimens are in the path of the rotor. Up to six samples can be tested at a time. When the tester is loaded, start it and tumble the specimen for a period of 10 minutes (±30 seconds.) After this time period, remove the specimen from the tester. Measure the diameter in the direction of the marking (↔) to measure the warp through the marking (↑↓) to measure the filling using a ⅛$^{th}$ inch graduated ruler R-9. Measure to first loose thread. The fraying value is expressed as a percentage and is calculated for both directions: % fray=(original length—tumbled length)/original length×100. (Note: original length 4.2) A lower fray value indicates a fabric has greater fray resistance. In particular, a lower warp fray value would suggest that a fabric would be more easily handled, thereby making product or garment manufacture more efficient.

Shrinkage—Shrinkage in the warp and filling directions was measured according to AATCC Test Method 135-1995.

Appearance—Wash appearance was rated according to AATCC Test Method 124-1996. The fabrics are rated on a scale from 1 to 5, with a higher rating indicating that the fabric retains a better appearance following washing.

Crease Retention—Crease Retention was measured according to AATCC Test Method 39C-1984. Fabrics are rated on a scale from 1 to 5, with a higher rating indicating that a fabric has greater crease retention.

Soil Release—The soil release properties of the fabrics were measured according to MTCC 130-1995 (corn oil), as follows: 0/1=Soiled prior to washing, tested after 1 wash. 4/5=Soiled after 4 washes, tested after 5 washes. 48/49=Soiled after 48 washes, tested after 49 washes. 48/50=Soiled after 48 washes, tested after 50 washes. 123/124=Soiled after 123 washes, tested after 124 washes. 123/125=Soiled after 123 washes, tested after 125 washes.

Vertical Wicking—Wicking was measured using a vertical wicking test as follows. The test is used to determine the rate at which water will wick on test specimens suspended in water.

Equipment: 1.500 ml Erlenmeyer flasks
2. Straight pins (approximately 3" in length)
3. Food coloring (any color to make water level visible on specimen)

Procedure: 1. Fill 500 ml Erlenmeyer flasks with 200 ml colored water (fill as many flasks as specimens to be tested).
2. A. Cut 6"×1" strip of specimens to be tested (6" length is cut in the wale direction).
B. Pierce top edge of strip (approximately ⅛"–¼" from top) with long straight pin.
3. Suspend strip from pin in flask filled with 200 ml colored water.
4. After 1 minute:
A. Remove strip from flask
B. Measure water level on strip in inches and record
C. Return strip to water
5. Repeat steps A., B., and C., from above at the following time intervals; 3 minutes, 5 minutes, and each 5 minute interval following until the water level reaches 6" or 1 hour has elapsed.

A higher score indicates the fabric has better wicking capability.

Drop Disappearance—Wicking was also measured according to a drop disappearance test as follows. This test method is used to determine the efficiency of the fabric in transporting or wicking the moisture (such as an aqueous perspiration).

Equipment: 1. Straight medicine dropper
2. Stop watch
3. Distilled water
4. Embroidery hoops Test Specimens: A sample large enough to test three different areas is required (preferably full fabric width).

Procedure: 1. Place the sample in an embroidery hoop and pull tight. (Care must be taken not to pull the sample too tight.)
2. The tip of the dropper should be one inch from the sample. Allow one drop of water to fall onto the sample. Start timer immediately. Watch the drop of water until it disappears and stop the time. Record the time required for the drop to disappear.
3. Repeat the above procedure on three different areas of each sample. Test samples "as received" and after five washings and tumble dryings, or as specified.

Report: The average time required for the drop of water to disappear. A lower time indicates a fabric absorbs moisture more quickly.

Thickness—Fabric thickness was measured according to ASTM D1777-1996.

Air Permeability—Air permeability was measured according to AATCC Test Method 737-1996. In many applications (such as those where a wearer will wear the garment in a hot environment), higher air permeability will enhance the wearer's perception of the comfort of the garment. The air permeability is measured in cubic ft/min of air that travel through the fabric, with a higher number indicating that the fabric is more breathable.

Flammability (After Flame)—Flammability (after flame) was measured according to National Fire Protection Agency ("NFPA") Test Method 701-1989. The test indicates how long a fabric continues to burn after the flame has expired (with a lower number generally being preferable in an FR product.)

Flammability (After Glow)—Flammability (after glow) was measured according to NFPA Test Method 701-1989. This test indicates how long a fabric continues to glow after the flame has expired (with a lower number generally being preferably in an FR product.

Flammability (Char Length)—Char Length was measured according to NFPA Test Method 701-1989. A lower char length indicates a lesser tendency of a fabric to burn. Generally, to be suitable for an FR garment, a fabric must have a char length of less than 4 inches.

Thermal Protection Performance (TPP)—Thermal Protection Performance was measured according to ASTM D4108-1996. A higher TPP value indicates that a fabric provides greater insulation.

Arc Thermal Protection Value (ATPV)—Arc Thermal Protection Value was measured according to ASTM F 1959-1999. A minimum of twenty-one samples were tested for each fabric, and the results were averaged. A higher ATPV indicates that a fabric provides greater protection against electrical arc exposure.

Pyroman Test—Burns were conducted on the Pyroman equipment (such as that available at the test labs at North Carolina State University) according to NFPA Test Method 2112 for 3 seconds. The % total body burn after each of the burns was recorded. A lower % body burn indicates the product is more protective of a wearer or user. A typical industry specification for a 3 second burn for a industrial garment (such as a pant or overall) is <50%.

Predicted Burn—Also using the Pyroman equipment and test method described above, fabrics were tested at various flame exposure times, and the level of predicted burn (second degree, third degree, and total) were recorded. Several samples of each Example fabric were run.

Handle-O-Meter—Handle-o-meter readings were measured in each of the warp and filling directions according to the following method, using Handle-o-meter model number 211-300 from Thwing Albert.

Using the Handle-O-Meter template (T-3), cut out three samples (face up). Be sure to cut samples at least 50 mm from selvage and/or 50 mm away from cut end of cloth. Avoid areas that have a fold or crease. Cut one from the left side, one from the center, and one from the right side. Label samples to indicate from where they were cut, and mark the warp and filling directions. Ensure the MODE selector is set in the TEST mode. If the Handle-O-Meter is not zeroed, unlock the ZERO control, adjust the knob until the indicator reads +000, then re-lock the ZERO control. Set MODE selector to PEAK. Place swatch over slot extending across the platform, FACE UP. To check the warp, turn sample 90 degrees so that the sample top is on the left. To check the filling, place the sample in the machine with the sample top in the 12:00 position. Press START/RESET control. Test the samples, starting with the warp right, then test the filling right Test the center and left side the same as above. Readings for standard should be recorded on 11ZHAND. Run Chart reading should be recorded on the correct style sheet and Data Document 11 ZCTAN. When all 3 warps and all 3 fillings have been tested, average the warp and filling measurements and record. Repeat for additional set. A lower Handle-O-Meter reading indicates that the fabric is more flexible. Readings were recorded in units of grams-force.

Drape—The drape coefficient was measured according to the following test process: Using an FRL® Drapemeter (of the variety described by Chu, C. C., Cummings, C. L. and Teixeira, N. A., in "Mechanics of Elastic Performance of Textile Materials Part V: A Study of the Factors Affecting the Drape of Fabrics—The Development of a Drape Meter", *Textile Research Journal* Vol 39 No.8,1950, pp. 539–548). This test is designed to determine the extent to which a fabric will deform when allowed to hang under its own weight, or by the ability of the fabric to drape by orienting itself into folds or pleats when acted upon by the force of gravity. The test used an FRL® Drapemeter, a uniform grade of tracing paper, a balance and scissors. The test specimens and tracing paper were conditioned to equilibrium and tested in the standard atmosphere of 65% relative humidity and 70° F. temperature. Moisture equilibrium shall be approached from the dry side (not moisture free.) Six test specimens (3 face up, and 3 face down), 10 inches in diameter were cut from the fabric. The specimens were taken from the right, center and left fabric areas, but no closer to the selvage than 1/10 of the fabric width. The specimens were marked as to face and back. A 10 inch diameter circle was cut from a uniform grade of tracing paper and it was weighed to the nearest milligram. The weight was recorded as W1. A 4 inch diameter circle (to represent the annular support ring) was cut and weighed to the nearest milligram. The weight was recorded as W2. A 10 inch diameter specimen was taken and a hole was made to mark the center of the test specimen. The specimen was placed on the support ring, and centered on the support. A sheet of tracing paper was placed on the clear top side of the Drapemeter. With the light source on, the paper was centered about the projected image of the fabric specimen and the outline of the shadow image was carefully traced on the paper. The traced image was cut out and the image paper was weighed to the nearest milligram, and recorded as W3.

The following calculation was made:

$$\text{Drape coefficient}=[(W3-W2)/(W1-W2)]\times 100, \text{ where}$$

W1=weight, 10 inch diameter paper, mg.

W2=weight, 4 inch diameter paper, mg

W3=weight, projected image, cut from paper used to obtain W1, mg.

The six readings were averaged, and reported as the Drape Coefficient. If a side effect was noticed (back vs. face), sides are reported separately. A lower drape coefficient indicates that the fabric is more drapeable.

Ring Test Load—Ring test load (i.e. Fabric handle by ring tensile) was measured according to the following test method. The test involves pulling the fabric through a ring at a set rate to determine the forces associated with friction and bending. A 10 inch diameter circle of the fabric to be tested was cut. The center of the circle was marked. The tensile tester was set up with a 38 mm diameter ring with a radius of 24 mm. The test speed was set at 10 inches/minute. A string was attached to a small fishhook, with the barb removed, and it was attached to the center of the fabric via the fishhook. The other end of the string was attached to the crosshead of the tensile tester. The tester was started and run until the fabric was pulled completely through the ring. The force required to pull the fabric through the ring and the modulus of the initial folding of the fabric as it approached the ring were recorded. A lower ring test load value indicates that a fabric is more supple and flexible.

Kawabata Testing—A variety of characteristics were measured using the Kawabata Evaluation System ("Kawabata System"). The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g. smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)

Kawabata Pure Bending Tester (KES FB2)

Kawabata Compression Tester (KES FB3)

Kawabata Surface Tester (KES FB4)

KES FB1 through 3 are manufactured by the Kato Iron Works Col, Ltd., Div. Of Instrumentation, Kyoto, Japan. KES FB4 (Kawabata Surface Tester) is manufactured by the Kato Tekko Co., Ltd., Div. Of Instrumentation, Kyoto, Japan. In each case, the measurements were performed according to the standard Kawabata Test Procedures, with four 8-inch ×8-inch samples of each type of fabric being tested, and the results averaged. Care was taken to avoid folding, wrinkling, stressing, or otherwise handling the samples in a way that would deform the sample. The fabrics were tested in their as-manufactured form (i.e. they had not undergone subsequent launderings.) The die used to cut each sample was aligned with the yarns in the fabric to improve the accuracy of the measurements.

Shear Measurements

The testing equipment was set up according to the instructions in the Kawabata manual. The Kawabata shear tester (KES FB1) was allowed to warm up for at least 15 minutes before being calibrated. The tester was set up as follows:

Sensitivity: 2 and ×5

Sample width: 20 cm

Shear weight: 195 g

Tensile Rate: 0.2 mm/s

Elongation Sensitivity: 25 mm

The shear test measures the resistive forces when the fabric is given a constant tensile force and is subjected to a shear deformation in the direction perpendicular to the constant tensile force.

Mean Shear Stiffness (G) [gf/(cm-deg)]. Mean shear stiffness was measured in each of the warp and filling directions. A lower value for shear stiffness is indicative of a more supple hand.

Shear Hysteresis at 0.50°, 2.50° and 50°—(2HG05, 2HG25, and 2HG50, respectively) [gf/cm]—A lower value indicates that the fabric recovers more completely from shear deformation. This correlates to a more supple hand.

Residual Shear Angle at 0.50, 2.50, and 5.00 (RG05, RG25, and RG50, respectively.) [degrees] The lower the number, the more "return energy" required to return the fabric to its original orientation.

Four samples were taken in each of the warp and filling directions, averaged, and are listed below.

Bending Measurements

Bending Stiffness (B)—A lower value means a fabric is less stiff.

Bending hysteresis at 0.50°, 1.00° , and 1.50° (2HB05, 2HB10, 2HB15) Mean bending stiffness per unit width at K=0.5, 1.0 and 1.5 $cm^{-1}$ [gf-cm/cm]. Bending stiffness was measured in each of the warp and filling. A lower value means the fabric recovers more completely from bending, and has a softer, more supple hand.

Residual Bending at 0.5°, 1.0°, and 1.5°—(RB05, RB10, RB15) Residual bending curvature at K=0.5, 1.0 and 1.5 $cm^{-1}$. A lower residual bending curvature indicates that a fabric is stiffer (less supple).

Compression Analysis

The testing equipment was set up according to the instructions in the Kawabata manual. The Kawabata Compression Tester (KES FB3) was allowed to warm up for at least 15 minutes before being calibrated. The tester was set up as follows:

Sensitivity: 2 and ×5

Stroke: 5 mm

Compression Rate: 1 mm/50 s

Sample Size: 20×20 cm

The compression test measured the resistive forces experienced by a plunger having a certain surface area as it moves alternately toward and away from a fabric sample in a direction perpendicular to the fabric. The test ultimately measures the work done in compressing the fabric (forward direction) to a preset maximum force and the work done while decompressing the fabric (reverse direction).

Percent compressibility at 0.5 grams (COMP05) The higher the measurement, the more compressible the fabric.

Maximum Thickness (TMAX)—Thickness [mm] at maximum pressure (nominal is 50 $gf/cm^2$). A higher TMAX indicates a loftier fabric.

Minimum Thickness (TMIN) Thickness at 0.5 g/sq cm. More is generally considered to be better. A higher TMIN indicates a loftier fabric.

Minimum Density—Density at TMIN (DMIN). Less is generally considered to be better) $T_{min}$[$g/cm^3$]

Maximum Density—Density at TMAX (DMAX)—$T_{max}$ [$g/cm^3$] A lower value is generally considered to be better.

Thickness Change During Compression (TDIFF)—Higher indicates a loftier fabric.

Compressional Work per Unit Area (WC) Energy to compress fabric to 50 $gf/cm^2$[$gf\text{-}cm/cm^2$]. More is generally considered to be better.

Decompressional Work per Unit Area (WC') This is an indication of the resilience of the fabric. A larger number indicates more resilience (i.e. a springier hand), which is generally considered to be better.

Linearity of Compression—0.5 grams-(LC05)—Compares compression work with the work along a hypothetical straight line from ($X_0$, $y(X_0)$) to ($X_{max}$, $y(X_{max})$) The closer to linear, the more consistent the fabic is.

% Compression Resilience—(RC) Higher means recovers better from compression.

Surface Analysis

The testing equipment was set up according to the instructions in the Kawabata Manual. The Kawabata Surface Tester (KES FB4) was allowed to warm up for at least 15 minutes before being calibrated. The tester was set up as follows:

Sensitivity 1: 2 and ×5

Sensitivity 2: 2 and ×5

Tension Weight: 480 g

Surface Roughness Weight: 10 g

Sample Size: 20×20 cm

The surface test measures frictional properties and geometric roughness properties of the surface of the fabric.

Coefficient of Friction—(MIU) Mean coefficient of friction [dimensionless]. This was tested in each of the warp and filling directions. A higher value indicates that the surface consists of more fiber ends and loops, which gives the fabric a soft, fuzzy hand.

Mean Deviation of Coefficient of Friction (MMD)—Indicates the level of consistency of the coefficient of friction.

Surface roughness (SMD) Mean deviation of the displacement of contactor normal to surface [microns]. Indicative of how rough the surface of the fabric is. A lower value indicates that a fabric surface has more fiber ends and loops that give a fabric a softer, more comfortable hand.

Tensile Analysis

Tensile Energy (WT) was measured in each of the warp and filling directions. A lower tensile energy generally indicates the fabric has "give" to it and is more extensible, which would be expected to be indicative of greater fabric comfort.

Linearity of Extension (LT)—Dimensionless—indicates consistency of extension.

Tensile Resiliency (RT)—Measured in percent. Indicates ability of fabric to recover from tensile stretch.

Percent Extensibility (EMT)—Measured in each of the warp and filling directions. A higher number indicates a fabric has a greater stretch property. (This is a static profile.)

TABLE A

| | Tensile Warp (LBS) | | | Tensile Fill (LBS) | | |
|---|---|---|---|---|---|---|
| Parameter | 0 Washes | 50 Washes | 100 Washes | 0 Washes | 50 Washes | 125 Washes |
| Example A | 236 | 215 | 227 | 130 | 140 | 140 |
| Example B | 221 | 204 | 206 | 131 | 142 | 146 |
| Example C | — | — | — | — | — | — |
| Example D | 235 | 213 | 224 | 166 | 150 | 159 |
| Example E | 212 | 199 | 212 | 133 | 135 | 149 |
| Example F | 231 | 210 | 209 | 152 | 139 | 138 |
| Example G | 235 | 213 | 224 | 166 | 150 | 159 |
| Example H | 78 | 78 | 86 | 40 | 44 | 66 |
| Example I | 139 | 137 | 123 | 83 | 75 | 97 |
| Example J | 87 | 84 | 77 | 59 | 59 | 65 |
| Example K | 139 | 140 | 106 | 84 | 87 | 90 |

TABLE B

| | Tear Warp (LBS) | | | Tear Fill (LBS) | | |
|---|---|---|---|---|---|---|
| Parameter | 0 Washes | 50 Washes | 125 Washes | 0 Washes | 50 Washes | 125 Washes |
| Example A | 15.4 | 10.6 | 8.9 | 12.7 | 7.2 | 6.5 |
| Example B | 13.2 | 8.7 | 8.6 | 10.3 | 6.7 | 6.7 |
| Example C | — | — | — | — | — | — |
| Example D | 14.3 | 9.1 | 9.1 | 9.8 | 7.6 | 6.3 |
| Example E | 13.4 | 9.4 | 10.2 | 8.1 | 7.3 | 6.7 |
| Example F | 9.7 | 8.4 | 8.7 | 8.2 | 5.9 | 6.3 |
| Example G | 14.3 | 9.1 | 9.1 | 9.8 | 7.6 | 6.3 |
| Example H | 7.7 | 6.4 | 4.3 | 8.0 | 7.1 | 3.5 |
| Example I | 8.2 | 4.2 | 4.4 | 7.8 | 4.9 | 4.9 |
| Example J | 8.2 | 4.1 | 3.9 | 7.8 | 4.3 | 3.6 |
| Example K | 7.3 | 4.4 | 3.6 | 9.2 | 4.7 | 5.1 |

TABLE C

| Parameter | Pilling—30 minutes (Rated 1–5) | | | Pilling—60 minutes (Rated 1–5) | | |
|---|---|---|---|---|---|---|
| | 0 Washes | 50 Washes | 125 Washes | 0 Washes | 50 Washes | 125 Washes |
| Example A | 4.0 | 5.0 | 5.0 | 4.0 | 5.0 | 5.0 |
| Example B | 4.0 | 5.0 | 5.0 | 4.0 | 5.0 | 5.0 |
| Example C | — | — | — | — | — | — |
| Example D | 4.3 | 4.8 | 5.0 | 4.3 | 4.8 | 5.0 |
| Example E | 4.0 | 5.0 | 4.5 | 4.0 | 4.5 | 5.0 |
| Example F | 4.0 | 5.0 | 5.0 | 4.0 | 5.0 | 5.0 |
| Example G | 4.3 | 4.8 | 5.0 | 4.3 | 4.8 | 5.0 |
| Example H | 4.5 | 5.0 | 4.0 | 4.5 | 5.0 | 2.5 |
| Example I | 4.5 | 5.0 | 5.0 | 4.5 | 5.0 | 5.0 |
| Example J | 4.5 | 4.5 | 5.0 | 4.5 | 4.5 | 4.0 |
| Example K | 4.5 | 5.0 | 5.0 | 4.5 | 5.0 | 5.0 |

TABLE D

| Parameter | Pilling—90 minutes (Rated 1–5) | | | Stoll Flat Abrasion (Cycles until sample falls apart—Test Maximum is 1000 cycles) | | |
|---|---|---|---|---|---|---|
| | 0 Washes | 50 Washes | 125 Washes | 0 Washes | 50 Washes | 125 Washes |
| Example A | 4.0 | 5.0 | 5.0 | 1000 | 1000 | 1000 |
| Example B | 4.0 | 5.0 | 5.0 | 1000 | 1000 | 1000 |
| Example C | — | — | — | — | — | — |
| Example D | 4.3 | 5.0 | 4.8 | 1000 | 1000 | 1000 |
| Example E | 4.0 | 5.0 | 4.5 | 1000 | 1000 | 1000 |
| Example F | 4.0 | 5.0 | 5.0 | 1000 | 1000 | 1000 |
| Example G | 4.3 | 5.0 | 4.8 | 1000 | 1000 | 1000 |
| Example H | 4.5 | 4.5 | 2.0 | 1000 | 1000 | 1000 |
| Example I | 4.5 | 5.0 | 5.0 | 1000 | 1000 | 1000 |
| Example J | 4.5 | 3.5 | 4.5 | 1000 | 1000 | 1000 |
| Example K | 4.5 | 5.0 | 5.0 | 1000 | 1000 | 1000 |

TABLE E

| Parameter | Seam Slippage-Warp (LBS) | | | Seam Slippage-Filling (LBS) | | |
|---|---|---|---|---|---|---|
| | 0 Washes | 50 Washes | 125 Washes | 0 Washes | 50 Washes | 125 Washes |
| Example A | 50 | 46.6 | 43.7 | 45 | 44 | 43.2 |
| Example B | 58 | 49 | 50 | 47 | 47 | 45 |
| Example C | — | — | — | — | — | — |
| Example D | 48 | 47 | 45 | 48 | 47 | 45 |
| Example E | 55 | 48 | 46 | 55 | 48 | 46 |
| Example F | 48 | 45 | 51 | 48 | 45 | 51 |
| Example G | 48 | 47 | 45 | 48 | 47 | 45 |
| Example H | 48 | 43 | 42 | 43 | 43 | 41 |
| Example I | 53 | 40 | 43 | 49 | 43 | 40 |
| Example J | 44 | 38 | 42 | 47 | 40 | 43 |
| Example K | 40 | 47 | 49 | 35 | 41 | 46 |

TABLE F

| Parameter | Warp Stretch (%) | | | Fill Stretch (%) | | |
|---|---|---|---|---|---|---|
| | 0 Washes | 50 Washes | 125 Washes | 0 Washes | 50 Washes | 125 Washes |
| Example A | 3.80 | 6.30 | 7.50 | 1.25 | 3.80 | 3.80 |
| Example B | 5.00 | 7.50 | 7.50 | 2.50 | 2.50 | 3.80 |
| Example C | — | — | — | — | — | — |
| Example D | 5.00 | 7.50 | 7.50 | 2.50 | 3.80 | 3.80 |
| Example E | 7.50 | 7.50 | 7.50 | 3.80 | 3.80 | 3.80 |
| Example F | 3.80 | 6.30 | 6.30 | 2.50 | 3.80 | 5.00 |
| Example G | 5.00 | 7.50 | 7.50 | 2.50 | 3.80 | 3.80 |
| Example H | 5.00 | 7.50 | 10.00 | 6.30 | 10.00 | 10.00 |
| Example I | 6.30 | 7.50 | 7.50 | 5.00 | 7.50 | 10.00 |
| Example J | 8.80 | 8.80 | 7.50 | 7.50 | 10.00 | 10.00 |
| Example K | 6.00 | 8.80 | 6.30 | 5.00 | 7.50 | 7.50 |

TABLE G

| Parameter | Fray Warp (%) | | | Fray Fill (%) | | |
|---|---|---|---|---|---|---|
| | 0 Washes | 50 Washes | 125 Washes | 0 Washes | 50 Washes | 125 Washes |
| Example A | 13.80 | 2.38 | 10.95 | 26.90 | 11.90 | 21.43 |
| Example B | 4.80 | 2.86 | 2.38 | 9.50 | 8.57 | 10.48 |
| Example C | — | — | — | — | — | — |
| Example D | 19.30 | 3.34 | 14.04 | 4.70 | 4.05 | 14.28 |
| Example E | 13.40 | 8.60 | 7.62 | 16.20 | 18.00 | 20.00 |
| Example F | 13.80 | 21.43 | 10.95 | 4.70 | 19.52 | 19.05 |
| Example G | 19.30 | 3.34 | 14.04 | 4.70 | 4.05 | 14.28 |
| Example H | 23.00 | 4.76 | 15.71 | 17.00 | 13.33 | 7.62 |
| Example I | 2.40 | 18.10 | 15.24 | 2.40 | 6.19 | 4.76 |
| Example J | 7.10 | 17.14 | 16.67 | 21.40 | 7.62 | 1.48 |
| Example K | 2.40 | 11.90 | 2.86 | 4.80 | 4.29 | 11.90 |

TABLE H

| Parameter | Shrinkage Warp (%) | | | Shrinkage Filling (%) | | |
|---|---|---|---|---|---|---|
| | 0 Washes | 50 Washes | 125 Washes | 0 Washes | 50 Washes | 125 Washes |
| Example A | 2.1 | 0.0 | 0.5 | 0.6 | 0.3 | 0.5 |
| Example B | 2.7 | 0.6 | 0.3 | 0.8 | 0.3 | 0.1 |
| Example C | — | — | — | — | — | — |
| Example D | 1.9 | 0.3 | 0.8 | 1.2 | 0.6 | 0.0 |
| Example E | 1.5 | 0.9 | 1.0 | 0.7 | 0.5 | 0.9 |
| Example F | 1.4 | 0.3 | 0.1 | 1.4 | 0.7 | 0.4 |
| Example G | 1.9 | 0.3 | 0.8 | 1.2 | 0.6 | 0.0 |
| Example H | 0.6 | 0.7+ | 0.3 | 3.1 | 0.2+ | 0.2 |
| Example I | 0.9 | 0.1 | 0.5 | 0.0 | 0.6 | 0.1 |
| Example J | 0.6 | 1.1 | 0.8 | 3.2 | 0.6 | 0.2 |
| Example K | 3.7 | 1.0 | 0.2 | 0.0 | 1.0 | 0.5 |

TABLE I

| Parameter | Appearance (Rated 1–5) | | | Crease Retention (Rated 1–5) | | |
|---|---|---|---|---|---|---|
| | 0 Washes | 50 Washes | 125 Washes | 0 Washes | 50 Washes | 125 Washes |
| Example A | 3.5 | 4.5 | 4.5 | 4.0 | 5.0 | 5.0 |
| Example B | 3.5 | 4.0 | 4.5 | 4.0 | 5.0 | 5.0 |
| Example C | — | — | — | — | — | — |

TABLE I-continued

| Parameter | Appearance (Rated 1–5) 0 Washes | 50 Washes | 125 Washes | Crease Retention (Rated 1–5) 0 Washes | 50 Washes | 125 Washes |
|---|---|---|---|---|---|---|
| Example D | 3.5 | 3.8 | 3.8 | 4.0 | 5.0 | 5.0 |
| Example E | 4.0 | 4.0 | 4.5 | 4.0 | 5.0 | 5.0 |
| Example F | 3.0 | 4.0 | 4.0 | 4.0 | 5.0 | 5.0 |
| Example G | 3.5 | 3.8 | 3.8 | 4.0 | 5.0 | 5.0 |
| Example H | 3.0 | 3.5 | 3.5 | 4.0 | 5.0 | 5.0 |
| Example I | 3.0 | 3.5 | 3.5 | 4.0 | 5.0 | 5.0 |
| Example J | 3.5 | 3.5 | 3.5 | 4.0 | 5.0 | 5.0 |
| Example K | 3.0 | 4.0 | 3.5 | 4.0 | 5.0 | 5.0 |

TABLE J

| Parameter | Soil Release (Rated 1–5) 0/1 | 4/5 | 48/49 | 48/50 | 123/124 | 123/125 |
|---|---|---|---|---|---|---|
| Example A | 2.5 | 3.5 | 4.5 | 2.5 | 3.5 | 4.5 |
| Example B | 3.3 | 3.0 | 4.0 | 4.5 | 4.0 | 5.0 |
| Example C | — | — | — | — | — | — |
| Example D | 2.0 | 1.3 | 2.4 | 3.6 | 1.9 | 3.9 |
| Example E | 1.5 | 2.0 | 3.0 | 3.7 | 2.5 | 3.0 |
| Example F | 2.0 | 1.0 | 2.6 | 3.4 | 2.3 | 4.3 |
| Example G | 2.0 | 1.3 | 2.4 | 3.6 | 1.9 | 3.9 |
| Example H | 1.0 | 1.0 | 1.5 | 2.6 | 1.3 | 4.0 |
| Example I | 1.0 | 1.0 | 1.5 | 3.9 | 1.5 | 4.3 |
| Example J | 1.0 | 1.0 | 3.1 | 4.3 | 3.8 | 4.5 |
| Example K | 1.0 | 1.0 | 1.6 | 1.8 | 1.0 | 3.5 |

TABLE K

| Parameter | Vertical Wicking-15 minutes (inches) 0 Washes | 50 Washes | 125 Washes | Drop Disappearance (seconds) 0 Washes | 50 Washes | 125 Washes |
|---|---|---|---|---|---|---|
| Example A | 5.9 | 4.7 | 5.1 | <1 sec | 1.7 | 2.5 |
| Example B | 6.8 | 4.7 | 4.7 | <1 sec | 2.0 | 1.7 |
| Example C | — | — | — | — | — | — |
| Example D | 4.6 | 5.3 | 5.8 | 2.2 | 2.7 | 4.4 |
| Example E | 4.9 | 5.3 | 5.9 | 3.0 | 3.8 | 3.9 |
| Example F | 5.6 | 6.5 | 6.6 | 5.3 | 4.7 | 4.0 |
| Example G | 4.6 | 5.3 | 5.8 | 2.2 | 2.7 | 4.4 |
| Example H | 5.1 | 6.4 | 6.4 | 3.1 | 0.4 | 0.8 |
| Example I | 5.1 | 5.4 | 5.0 | 2.9 | 0.7 | 0.5 |
| Example J | 5.2 | 6.6 | 6.6 | 1.5 | 0.3 | 0.4 |
| Example K | 4.7 | 5.5 | 5.1 | 2.5 | 0.6 | 0.7 |

TABLE L

| Parameter | Thickness (mm) 0 Washes | 50 Washes | 125 Washes | Air Permeability (cfm) 0 Washes | 50 Washes | 125 Washes |
|---|---|---|---|---|---|---|
| Example A | 19.40 | 22.32 | 22.01 | 84.4 | 61 | 58.8 |
| Example B | 22.48 | 25.63 | 25.16 | 77.6 | 57.6 | 55.3 |
| Example C | — | — | — | — | — | — |
| Example D | 19.87 | 22.10 | 21.85 | 47.3 | 39.5 | 42.8 |
| Example E | 20.78 | 21.33 | 21.88 | 80.6 | 83.4 | 84.6 |
| Example F | 21.25 | 21.63 | 22.13 | 47.1 | 78.3 | 80.2 |
| Example G | 19.87 | 22.10 | 21.85 | 47.3 | 39.5 | 42.8 |
| Example H | 16.5 | 25.13 | 25.63 | 54.1 | 53.8 | 64.7 |
| Example I | 22.33 | 29.19 | 28.88 | 19.6 | 10.6 | 10.9 |
| Example J | 19.65 | 26.32 | 26.13 | 37.6 | 55.2 | 58.1 |
| Example K | 23.65 | 29.69 | 30.44 | 26.07 | 10 | 9.84 |

TABLE M

| Parameter | Flammability-After Flame (seconds) 0 Washes | 50 Washes | 125 Washes | Flammability-After Glow (seconds) 0 Washes | 50 Washes | 125 Washes |
|---|---|---|---|---|---|---|
| Example A | <1 sec | <1 sec | <1 sec | <1 sec | <1 sec | <1 sec |
| Example B | <1 sec | <1 sec | <1 sec | <1 sec | <1 sec | <1 sec |
| Example C | — | — | — | — | — | — |
| Example D | <1 sec | <1 sec | <1 sec | <1 sec | <1 sec | <1 sec |

TABLE M-continued

| Parameter | Flammability-After Flame (seconds) | | | Flammability-After Glow (seconds) | | |
|---|---|---|---|---|---|---|
| | 0 Washes | 50 Washes | 125 Washes | 0 Washes | 50 Washes | 125 Washes |
| Example E | <1 sec | <1 sec | <1 sec | <1 sec | <1 sec | <1 sec |
| Example F | <1 sec | <1 sec | <1 sec | <1 sec | <1 sec | <1 sec |
| Example G | <1 sec | <1 sec | <1 sec | <1 sec | <1 sec | <1 sec |
| Example H | <1 sec | <1 sec | <1 sec | <1 sec | <1 sec | <1 sec |
| Example I | <1 sec | <1 sec | <1 sec | <1 sec | <1 sec | <1 sec |
| Example J | <1 sec | <1 sec | <1 sec | <1 sec | <1 sec | <1 sec |
| Example K | <1 sec | <1 sec | <1 sec | <1 sec | <1 sec | <1 sec |

TABLE N

| Parameter | Flammability-Char Length (inches) | | | Thermal Protection Performance (TPP) (calories/cubic cm) |
|---|---|---|---|---|
| | 0 Washes | 50 Washes | 125 Washes | 0 Washes |
| Example A | 1.9 | 2.9 | 3.1 | 8.83 |
| Example B | 2.3 | 3.1 | 2.3 | 9.21 |
| Example C | — | — | — | — |
| Example D | 3.8 | 2.3 | 2.4 | 9.19 |
| Example E | 3.9 | 2.1 | 2.0 | — |
| Example F | 3.6 | 2.3 | 2.8 | 9.25 |
| Example G | 3.8 | 2.3 | 2.1 | 9.19 |
| Example H | 3.1 | 1.9 | 2.4 | 7.48 |
| Example I | 2.5 | 1.9 | 2.4 | 9.53 |
| Example J | 3.2 | 2.9 | 3.8 | 8.90 |
| Example K | 3.4 | 2.6 | 2.1 | — |

TABLE O

| Parameter | Arc Thermal Protection Value (ATPV) (calories/cm$^2$) All are washed as part of test | Pyroman 3 seconds |
|---|---|---|
| Example A | 6.1 | — |
| Example B | 6.0 | 28 |
| Example C | — | — |
| Example D | 5.7 | <50 R |
| Example E | — | <50 R |
| Example F | 5.6 | <50 R |
| Example G | 5.7 | <50 R |
| Example H | 6.0 R | <50 R |
| Example I | 7.9 R | <50 R |
| Example J | 7.3 R | <50 R |
| Example K | 11.2 R | <50 R |

R = recorded in the literature

TABLE P

| Example | Flame Exposure (sec) | Predicted Burn | | |
|---|---|---|---|---|
| | | Second Degree | Third Degree | Total |
| Example B Sample 1 | 4.00 | 40.98 | 8.20 | 49.18 |
| Example B Sample 2 | 4.00 | 45.08 | 8.20 | 53.28 |
| Example B Sample 3 | 4.00 | 41.80 | 9.02 | 50.82 |

TABLE P-continued

| Example | Flame Exposure (sec) | Predicted Burn | | |
|---|---|---|---|---|
| | | Second Degree | Third Degree | Total |
| Average | | 42.62 | 8.47 | 51.09 |
| Example B Sample 1 | 3.00 | 18.85 | 6.56 | 25.41 |
| Example B Sample 2 | 3.00 | 22.13 | 6.56 | 28.69 |
| Example B Sample 3 | 3.00 | 23.77 | 6.56 | 30.33 |
| Average | | 21.59 | 6.56 | 28.14 |
| Example B Sample 1 | 3.50 | 28.69 | 6.56 | 28.14 |
| Example B Sample 1 | 5.00 | 39.34 | 22.95 | 62.30 |
| Example B Sample 2 | 5.00 | 43.44 | 18.03 | 61.48 |
| Example B Sample 3 | 5.00 | 42.62 | 20.49 | 63.11 |
| Average | | 41.80 | 20.49 | 62.29 |

TABLE Q

| Parameter | Handle-O-Meter-Warp (grams force) 0 Washes | Handle-O-Meter-Filling (grams force) 0 Washes |
|---|---|---|
| Example A | 33 | 27 |
| Example B | 34 | 26 |
| Example C | — | — |
| Example D | 97 | 70 |
| Example E | 109 | 79 |
| Example F | 124 | 52 |
| Example G | 97 | 70 |
| Example H | 41 | 21 |
| Example I | 192 | 182 |
| Example J | 32 | 18 |
| Example K | 209 | 264 |

TABLE R

| | Drape Coefficient (0–100) | | | Ring Test Load (lbs.) | | |
|---|---|---|---|---|---|---|
| Parameter | 0 Washes | 50 Washes | 125 Washes | 0 Washes | 50 Washes | 125 Washes |
| Example A | 33.4 | 26.86 | 26.50 | 72.64 | 59.25 | 72.36 |
| Example B | 30.90 | 28.46 | 24.17 | 90.80 | 66.93 | 102.10 |
| Example C | — | — | — | — | — | — |
| Example D | 64.90 | 34.61 | 31.20 | 208.84 | 90.25 | 83.71 |
| Example E | 70.60 | 31.08 | — | 249.70 | 83.28 | — |
| Example F | 65.20 | 33.47 | 30.54 | 340.50 | 93.00 | 89.86 |
| Example G | 64.90 | 34.61 | 31.20 | 208.84 | 80.25 | 83.71 |
| Example H | 39.3 | 38.8 | 31.7 | 140.74 | 120.190 | 121.277 |
| Example I | 74.0 | 56.5 | 47.3 | 612.90 | 541.826 | 297.478 |
| Example J | 34.4 | 37.3 | 35.9 | 136.20 | 97.203 | 100.951 |
| Example K | 80.3 | 53.0 | 51.2 | 862.60 | 352.747 | 392.280 |

TABLE S

| | Bending Stiffness (B) Warp Direction | | | Bending Stiffness (B) Filling Direction | | |
|---|---|---|---|---|---|---|
| Parameter | 0 Washes | 50 Washes | 125 Washes | 0 Washes | 50 Washes | 125 Washes |
| Example A | 0.140 | 0.091 | 0.085 | 0.101 | 0.083 | 0.088 |
| Example B | 0.15 | 0.088 | 0.084 | 0.11 | 0.090 | 0.089 |
| Example C | — | — | — | — | — | — |
| Example D | 0.766 | 0.130 | 0.101 | 0.418 | 0.112 | 0.087 |
| Example E | 0.723 | 0.120 | 0.112 | 0.371 | 0.085 | 0.073 |
| Example F | 0.903 | 0.270 | 0.260 | 0.324 | 0.090 | 0.081 |
| Example G | 0.766 | 0.130 | 0.101 | 0.418 | 0.112 | 0.087 |
| Example H | 0.21 | 0.162 | 0.119 | 0.13 | 0.084 | 0.080 |
| Example I | 1.04 | 0.359 | 0.337 | 1.06 | 0.214 | 0.214 |
| Example J | 0.17 | 0.173 | 0.169 | 0.12 | 0.083 | 0.092 |
| Example K | 1.50 | 0.362 | 0.398 | 1.66 | 0.226 | 0.257 |

TABLE T

| | % Compressibility (Comp 05) | | |
|---|---|---|---|
| Parameter | 0 Washes | 50 Washes | 125 Washes |
| Example A | 40.680 | 42.808 | 42.141 |
| Example B | 40.126 | 45.044 | 42.182 |
| Example C | 42.459 | 44.727 | 42.398 |
| Example D | 33.454 | 40.529 | 38.959 |
| Example E | 34.717 | 41.842 | 40.427 |
| Example F | 36.736 | 41.994 | 42.182 |
| Example G | 33.454 | 40.529 | 38.959 |
| Example H | 40.432 | 39.837 | 34.407 |
| Example I | 31.886 | 29.658 | 25.763 |
| Example J | 39.871 | 37.860 | 33.236 |
| Example K | 32.183 | 33.251 | 27.035 |

TABLE U

| | Shear Stiffness (G) Warp | | | Shear Stiffness (G) Filling | | |
|---|---|---|---|---|---|---|
| Parameter | 0 Washes | 50 Washes | 125 Washes | 0 Washes | 50 Washes | 125 Washes |
| Example A | 0.7770 | 0.658 | 0.592 | 0.6357 | 0.489 | 0.435 |
| Example B | 0.9590 | 0.739 | 0.612 | 0.7833 | 0.583 | 0.490 |
| Example C | 0.9260 | 0.701 | 0.653 | 0.7683 | 0.569 | 0.521 |
| Example D | 3.4670 | 1.068 | 0.968 | 3.3963 | 1.028 | 0.871 |
| Example E | 2.4437 | 0.692 | 0.633 | 2.2013 | 0.615 | 0.568 |

TABLE U-continued

| Parameter | Shear Stiffness (G) Warp | | | Shear Stiffness (G) Filling | | |
|---|---|---|---|---|---|---|
| | 0 Washes | 50 Washes | 125 Washes | 0 Washes | 50 Washes | 125 Washes |
| Example F | 2.2210 | 0.512 | 0.498 | 2.0490 | 0.470 | 0.403 |
| Example G | 2.9357 | 1.068 | 0.968 | 2.7140 | 1.028 | 0.871 |
| Example H | 0.7547 | 0.838 | 0.835 | 0.6633 | 0.829 | 0.734 |
| Example I | 2.7373 | 2.763 | 2.575 | 2.6953 | 2.773 | 2.662 |
| Example J | 0.9037 | 0.845 | 0.868 | 0.8197 | 0.772 | 0.757 |
| Example K | 3.0097 | 2.905 | 3.268 | 2.9207 | 3.096 | 3.307 |

TABLE V

| Parameter | Coefficient of Friction (MIU) Warp | | | Coefficient of Friction (MIU) Filling | | |
|---|---|---|---|---|---|---|
| | 0 Washes | 50 Washes | 125 Washes | 0 Washes | 50 Washes | 125 Washes |
| Example A | 0.193000 | 0.212 | 0.214 | 0.217667 | 0.222 | 0.227 |
| Example B | 0.213667 | 0.217 | 0.216 | 0.224667 | 0.224 | 0.227 |
| Example C | 0.209667 | 0.217 | 0.223 | 0.219667 | 0.229 | 0.233 |
| Example D | 0.189333 | 0.211 | 0.214 | 0.199667 | 0.218 | 0.233 |
| Example E | 0.187000 | 0.202 | 0.208 | 0.187000 | 0.225 | 0.227 |
| Example F | 0.209667 | 0.199 | 0.210 | 0.221667 | 0.212 | 0.219 |
| Example G | 0.185667 | 0.211 | 0.214 | 0.201667 | 0.218 | 0.233 |
| Example H | 0.217333 | 0.231 | 0.228 | 0.225667 | 0.257 | 0.250 |
| Example I | 0.178333 | 0.221 | 0.226 | 0.194667 | 0.246 | 0.242 |
| Example J | 0.217000 | 0.231 | 0.247 | 0.233333 | 0.253 | 0.273 |
| Example K | 0.177000 | 0.242 | 0.231 | 0.198333 | 0.252 | 0.241 |

TABLE W

| Parameter | WT Warp | | | WT Filling | | |
|---|---|---|---|---|---|---|
| | 0 Washes | 50 Washes | 125 Washes | 0 Washes | 50 Washes | 125 Washes |
| Example A | 10.521 | 12.639000 | 13.34970 | 5.375 | 7.151300 | 7.28630 |
| Example B | 10.668 | 13.716700 | 13.59600 | 5.444 | 7.536700 | 7.66530 |
| Example C | 11.006 | 13.672700 | 13.76430 | 5.578 | 7.473700 | 7.68270 |
| Example D | 9.262 | 13.063700 | 12.90800 | 4.917 | 7.490700 | 7.30570 |
| Example E | 8.198 | 11.222700 | 11.92700 | 5.533 | 6.780700 | 6.95670 |
| Example F | 10.673 | 13.130000 | 13.12900 | 6.191 | 8.625300 | 8.51500 |
| Example G | 10.931 | 12.657700 | 13.06700 | 6.012 | 6.696000 | 7.33100 |
| Example H | 9.494 | 12.851700 | 14.12670 | 15.510 | 18.642000 | 20.06800 |
| Example I | 13.509 | 13.933700 | 15.92600 | 13.516 | 16.307700 | 16.75200 |
| Example J | 12.471 | 13.630700 | 14.99430 | 17.192 | 18.972700 | 19.43500 |
| Example K | 14.217 | 14.322700 | 17.07100 | 11.616 | 16.035300 | 16.29770 |

TABLE X

| Parameter | % Extensibility (EMT) Warp | | | % Extensibility (EMT) Filling | | |
|---|---|---|---|---|---|---|
| | 0 Washes | 50 Washes | 125 Washes | 0 Washes | 50 Washes | 125 Washes |
| Example A | 5.8950 | 8.562 | 8.977 | 2.9100 | 4.808 | 4.575 |
| Example B | 6.2217 | 8.905 | 8.788 | 2.9967 | 4.982 | 4.797 |
| Example C | 5.9317 | 9.125 | 8.725 | 3.3033 | 5.045 | 4.703 |
| Example D | 5.1833 | 8.161 | 8.024 | 2.9167 | 4.455 | 4.553 |
| Example E | 3.9750 | 7.585 | 7.320 | 3.0500 | 4.508 | 3.862 |
| Example F | 6.0233 | 8.135 | 8.160 | 3.6250 | 5.608 | 5.385 |
| Example G | 5.8650 | 8.161 | 8.024 | 3.1783 | 4.455 | 4.553 |

TABLE X-continued

| | % Extensibility (EMT) Warp | | | % Extensibility (EMT) Filling | | |
|---|---|---|---|---|---|---|
| Parameter | 0 Washes | 50 Washes | 125 Washes | 0 Washes | 50 Washes | 125 Washes |
| Example H | 6.3400 | 8.465 | 9.192 | 9.8617 | 12.215 | 13.150 |
| Example I | 7.8883 | 8.083 | 8.982 | 6.6200 | 9.277 | 9.210 |
| Example J | 7.3300 | 8.942 | 9.871 | 11.3317 | 12.400 | 12.537 |
| Example K | 7.6650 | 8.323 | 9.702 | 6.0950 | 9.250 | 8.527 |

TABLE Y

| | Bending Hysteresis (2HB05) Warp | | | Bending Hysteresis (2HB05) Filling | | |
|---|---|---|---|---|---|---|
| Parameter | 0 Washes | 50 Washes | 125 Washes | 0 Washes | 50 Washes | 125 Washes |
| Example A | 0.07200 | 0.045330 | 0.04067 | 0.06400 | 0.052333 | 0.04433 |
| Example B | 0.07400 | 0.046670 | 0.04600 | 0.06967 | 0.045667 | 0.04400 |
| Example C | 0.07133 | 0.047000 | 0.04900 | 0.05567 | 0.055333 | 0.03900 |
| Example D | 0.25633 | 0.061670 | 0.05067 | 0.20100 | 0.059667 | 0.04500 |
| Example E | 0.22133 | 0.069670 | 0.05800 | 0.13933 | 0.054667 | 0.04333 |
| Example F | 0.28000 | 0.165670 | 0.12800 | 0.14500 | 0.052000 | 0.04300 |
| Example G | 0.25667 | 0.078330 | 0.05867 | 0.22467 | 0.076333 | 0.05100 |
| Example H | 0.11900 | 0.113330 | 0.09300 | 0.05200 | 0.049333 | 0.05200 |
| Example I | 0.30133 | 0.208670 | 0.19967 | 0.22333 | 0.135667 | 0.14833 |
| Example J | 0.10467 | 0.114330 | 0.15000 | 0.06200 | 0.051333 | 0.06733 |
| Example K | 0.39700 | 0.244330 | 0.35900 | 0.32400 | 0.152333 | 0.19800 |

TABLE Z

| | Bending Hysteresis (2HB10) Warp | | | Bending Hysteresis (2HB10) Filling | | |
|---|---|---|---|---|---|---|
| Parameter | 0 Washes | 50 Washes | 125 Washes | 0 Washes | 50 Washes | 125 Washes |
| Example A | 0.07467 | 0.056330 | 0.05033 | 0.06500 | 0.064000 | 0.06033 |
| Example B | 0.08267 | 0.058000 | 0.05600 | 0.07400 | 0.059333 | 0.05967 |
| Example C | 0.08067 | 0.058670 | 0.06133 | 0.07000 | 0.072000 | 0.01533 |
| Example D | 0.38700 | 0.078330 | 0.06567 | 0.26567 | 0.077333 | 0.05800 |
| Example E | 0.30867 | 0.089000 | 0.07633 | 0.18467 | 0.067667 | 0.05433 |
| Example F | 0.39633 | 0.223330 | 0.18700 | 0.17433 | 0.067667 | 0.05633 |
| Example G | 0.33067 | 0.098000 | 0.07333 | 0.26167 | 0.096000 | 0.06500 |
| Example H | 0.11700 | 0.146330 | 0.11600 | 0.05967 | 0.058333 | 0.06033 |
| Example I | 0.37533 | 0.295330 | 0.28667 | 0.32200 | 0.175667 | 0.18533 |
| Example J | 0.37533 | 0.156330 | 0.17933 | 0.06100 | 0.061333 | 0.07767 |
| Example K | 0.49600 | 0.332000 | 0.44800 | 0.44433 | 0.189667 | 0.24333 |

TABLE AA

| | Bending Hysteresis (2HB15) Warp | | | Bending Hysteresis (2HB15) Filling | | |
|---|---|---|---|---|---|---|
| Parameter | 0 Washes | 50 Washes | 125 Washes | 0 Washes | 50 Washes | 125 Washes |
| Example A | 0.07567 | 0.067670 | 0.05967 | 0.06333 | 0.074333 | 0.07000 |
| Example B | 0.08367 | 0.068670 | 0.06200 | 0.06567 | 0.068000 | 0.07400 |
| Example C | 0.08433 | 0.068000 | 0.07167 | 0.08400 | 0.084667 | 0.06267 |
| Example D | 0.40967 | 0.092670 | 0.07967 | 0.27933 | 0.099333 | 0.07400 |
| Example E | 0.31733 | 0.110670 | 0.09600 | 0.19767 | 0.078667 | 0.06467 |
| Example F | 0.42800 | 0.272670 | 0.24033 | 0.18567 | 0.082000 | 0.07067 |
| Example G | 0.32300 | 0.116330 | 0.08800 | 0.25333 | 0.119333 | 0.07967 |
| Example H | 0.11133 | 0.179330 | 0.13333 | 0.05133 | 0.070000 | 0.06833 |

TABLE AA-continued

| | Bending Hysteresis (2HB15) Warp | | | Bending Hysteresis (2HB15) Filling | | |
|---|---|---|---|---|---|---|
| Parameter | 0 Washes | 50 Washes | 125 Washes | 0 Washes | 50 Washes | 125 Washes |
| Example I | 0.39967 | 0.381670 | 0.37400 | 0.34700 | 0.218333 | 0.22733 |
| Example J | 0.10467 | 0.187330 | 0.19333 | 0.05667 | 0.073333 | 0.08333 |
| Example K | 0.51467 | 0.422330 | 0.48267 | 0.48967 | 0.233333 | 0.29467 |

TABLE BB

| | Residual Bending (RB05) Warp | | | Residual Bending (RB05) Filling | | |
|---|---|---|---|---|---|---|
| Parameter | 0 Washes | 50 Washes | 125 Washes | 0 Washes | 50 Washes | 125 Washes |
| Example A | 0.52267 | 0.499330 | 0.48167 | 0.65300 | 0.577000 | 0.50700 |
| Example B | 0.48467 | 0.528670 | 0.55067 | 0.67033 | 0.554670 | 0.49233 |
| Example C | 0.46500 | 0.539670 | 0.53133 | 0.42467 | 0.545000 | 0.48533 |
| Example D | 0.28033 | 0.562670 | 0.49800 | 0.43867 | 0.556000 | 0.52333 |
| Example E | 0.30667 | 0.590000 | 0.51667 | 0.37733 | 0.637670 | 0.59033 |
| Example F | 0.32100 | 0.612670 | 0.49200 | 0.45633 | 0.572000 | 0.53333 |
| Example G | 0.42333 | 0.628330 | 0.58600 | 0.60833 | 0.655000 | 0.58133 |
| Example H | 0.57333 | 0.699000 | 0.78633 | 0.41467 | 0.587330 | 0.64667 |
| Example I | 0.28500 | 0.582330 | 0.59933 | 0.21333 | 0.633000 | 0.69267 |
| Example J | 0.63133 | 0.665000 | 0.88633 | 0.53767 | 0.617330 | 0.73233 |
| Example K | 0.26100 | 0.684000 | 0.89667 | 0.19100 | 0.675000 | 0.76933 |

TABLE CC

| | Residual Bending (RB10) Warp | | | Residual Bending (RB10) Filling | | |
|---|---|---|---|---|---|---|
| Parameter | 0 Washes | 50 Washes | 125 Washes | 0 Washes | 50 Washes | 125 Washes |
| Example A | 0.53933 | 0.621330 | 0.58967 | 0.65467 | 0.707000 | 0.68233 |
| Example B | 0.54333 | 0.660330 | 0.66467 | 0.71600 | 0.715330 | 0.66367 |
| Example C | 0.52233 | 0.675330 | 0.66500 | 0.52167 | 0.714330 | 0.63567 |
| Example D | 0.42067 | 0.714000 | 0.64367 | 0.57767 | 0.720000 | 0.67600 |
| Example E | 0.42767 | 0.748330 | 0.68233 | 0.50067 | 0.789670 | 0.74600 |
| Example F | 0.44433 | 0.827670 | 0.71633 | 0.54300 | 0.747000 | 0.69767 |
| Example G | 0.54467 | 0.783330 | 0.73167 | 0.70667 | 0.825330 | 0.74033 |
| Example H | 0.56300 | 0.901670 | 0.97667 | 0.47300 | 0.692670 | 0.75300 |
| Example I | 0.35800 | 0.824330 | 0.85567 | 0.30567 | 0.820330 | 0.86333 |
| Example J | 0.63833 | 0.903000 | 1.05867 | 0.52967 | 0.738330 | 0.83967 |
| Example K | 0.33100 | 0.924000 | 1.12200 | 0.26533 | 0.839670 | 0.94600 |

50

TABLE DD

| | Residual Bending (RB15) Warp | | | Residual Bending (RB15) Filling | | |
|---|---|---|---|---|---|---|
| Parameter | 0 Washes | 50 Washes | 125 Washes | 0 Washes | 50 Washes | 125 Washes |
| Example A | 0.54700 | 0.747000 | 0.70167 | 0.62800 | 0.823000 | 0.79767 |
| Example B | 0.55100 | 0.782000 | 0.74033 | 0.62467 | 0.824000 | 0.82500 |
| Example C | 0.54800 | 0.784000 | 0.77767 | 0.62800 | 0.845330 | 0.77333 |
| Example D | 0.44433 | 0.844000 | 0.78300 | 0.60500 | 0.925330 | 0.85667 |
| Example E | 0.43867 | 0.923330 | 0.85833 | 0.53367 | 0.920670 | 0.88400 |
| Example F | 0.47800 | 1.008000 | 0.92300 | 0.56967 | 0.903000 | 0.87533 |
| Example G | 0.53167 | 0.928330 | 0.88167 | 0.68467 | 1.021330 | 0.90500 |
| Example H | 0.53633 | 1.102670 | 1.12200 | 0.40333 | 0.826000 | 0.86167 |
| Example I | 0.38467 | 1.064670 | 1.11433 | 0.32767 | 1.021000 | 1.05967 |

TABLE DD-continued

| | Residual Bending (RB15) Warp | | | Residual Bending (RB15) Filling | | |
|---|---|---|---|---|---|---|
| Parameter | 0 Washes | 50 Washes | 125 Washes | 0 Washes | 50 Washes | 125 Washes |
| Example J | 0.63400 | 1.079000 | 1.13933 | 0.49167 | 0.881000 | 0.90800 |
| Example K | 0.34567 | 1.174670 | 1.21867 | 0.29800 | 1.033000 | 1.14533 |

TABLE EE

| | Maximum Thickness (Tmax) (mm) | | | Maximum Density (DENMAX) | | |
|---|---|---|---|---|---|---|
| Parameter | 0 Washes | 50 Washes | 125 Washes | 0 Washes | 50 Washes | 125 Washes |
| Example A | 0.536333 | 0.586000 | 0.58567 | 0.371000 | 0.367000 | 0.36700 |
| Example B | 0.582333 | 0.666333 | 0.67167 | 0.350333 | 0.333000 | 0.32967 |
| Example C | 0.588000 | 0.662000 | 0.64767 | 0.349000 | 0.333667 | 0.34000 |
| Example D | 0.551000 | 0.588000 | 0.57867 | 0.381333 | 0.377000 | 0.38367 |
| Example E | 0.555667 | 0.577333 | 0.57500 | 0.361000 | 0.351333 | 0.35067 |
| Example F | 0.585667 | 0.582333 | 0.59133 | 0.352667 | 0.362000 | 0.35567 |
| Example G | 0.543667 | 0.577667 | 0.56533 | 0.394667 | 0.381000 | 0.39200 |
| Example H | 0.496000 | 0.633667 | 0.65533 | 0.462333 | 0.377333 | 0.34600 |
| Example I | 0.604000 | 0.716000 | 0.75100 | 0.530000 | 0.465000 | 0.43633 |
| Example J | 0.518333 | 0.690333 | 0.67833 | 0.451000 | 0.34433 | 0.34367 |
| Example K | 0.631000 | 0.752667 | 0.79700 | 0.534333 | 0.448333 | 0.43000 |

TABLE FF

| | Minimum Thickness (Tmin) (mm) | | | Minimum Density (DENMIN) | | |
|---|---|---|---|---|---|---|
| Parameter | 0 Washes | 50 Washes | 125 Washes | 0 Washes | 50 Washes | 125 Washes |
| Example A | 0.904330 | 1.025000 | 1.01233 | 0.220333 | 0.210000 | 0.21233 |
| Example B | 0.972670 | 1.212670 | 1.16200 | 0.209667 | 0.182667 | 0.19067 |
| Example C | 1.022330 | 1.197330 | 1.12367 | 0.201000 | 0.184333 | 0.19567 |
| Example D | 0.794330 | 0.987670 | 0.96000 | 0.264667 | 0.224333 | 0.23133 |
| Example E | 0.852000 | 0.992670 | 0.96533 | 0.235667 | 0.204667 | 0.20900 |
| Example F | 0.927330 | 1.004330 | 1.02233 | 0.223000 | 0.210000 | 0.20600 |
| Example G | 0.853330 | 0.973000 | 0.91500 | 0.251000 | 0.226667 | 0.24267 |
| Example H | 0.833000 | 1.054670 | 0.99900 | 0.275000 | 0.227333 | 0.22700 |
| Example I | 0.887670 | 1.018000 | 1.01133 | 0.361000 | 0.326667 | 0.32400 |
| Example J | 0.862670 | 1.111000 | 1.01600 | 0.271333 | 0.214000 | 0.22933 |
| Example K | 0.930670 | 1.127670 | 1.09167 | 0.362333 | 0.299333 | 0.31367 |

TABLE GG

| | Compressional Work per Unit Area (WC) | | | Linearity of Compression (LC 05) | | |
|---|---|---|---|---|---|---|
| Parameter | 0 Washes | 50 Washes | 125 Washes | 0 Washes | 50 Washes | 125 Washes |
| Example A | 0.300000 | 0.407000 | 0.38300 | 0.32533 | 0.369670 | 0.35933 |
| Example B | 0.385000 | 0.517330 | 0.48633 | 0.39733 | 0.379670 | 0.39833 |
| Example C | 0.411000 | 0.510670 | 0.45800 | 0.38033 | 0.381670 | 0.38533 |
| Example D | 0.203670 | 0.359330 | 0.33200 | 0.33633 | 0.362330 | 0.34967 |
| Example E | 0.215000 | 0.357330 | 0.32633 | 0.29533 | 0.345670 | 0.33533 |
| Example F | 0.282330 | 0.368330 | 0.38300 | 0.33233 | 0.347330 | 0.35733 |
| Example G | 0.254670 | 0.386670 | 0.34100 | 0.32767 | 0.393000 | 0.39200 |
| Example H | 0.286670 | 0.370000 | 0.33900 | 0.33933 | 0.353000 | 0.39667 |
| Example I | 0.257670 | 0.322330 | 0.28767 | 0.36767 | 0.432000 | 0.44000 |
| Example J | 0.299000 | 0.401330 | 0.33233 | 0.34933 | 0.382670 | 0.39833 |
| Example K | 0.265670 | 0.362330 | 0.31333 | 0.35433 | 0.389670 | 0.42667 |

TABLE HH

| | Decompressional Work per Unit Area (WCPrime) | | | Compression Resilience (RC) % | | |
|---|---|---|---|---|---|---|
| Parameter | 0 Washes | 50 Washes | 125 Washes | 0 Washes | 50 Washes | 125 Washes |
| Example A | 0.153333 | 0.177000 | 0.16300 | 51.2443 | 43.446300 | 42.50530 |
| Example B | 0.209667 | 0.219667 | 0.20800 | 53.0833 | 42.429700 | 42.76830 |
| Example C | 0.218000 | 0.223000 | 0.19767 | 54.3957 | 43.721000 | 43.21800 |
| Example D | 0.115333 | 0.155667 | 0.14267 | 56.6363 | 43.275300 | 43.03830 |
| Example E | 0.117333 | 0.159000 | 0.14233 | 54.5963 | 44.414000 | 43.63930 |
| Example F | 0.137667 | 0.165333 | 0.16633 | 48.9260 | 44.944300 | 43.43170 |
| Example G | 0.132333 | 0.159667 | 0.13967 | 51.8593 | 41.299000 | 40.81070 |
| Example H | 0.126667 | 0.130333 | 0.12000 | 44.2787 | 35.217700 | 35.42070 |
| Example I | 0.125000 | 0.105333 | 0.10333 | 48.4010 | 32.861000 | 35.95200 |
| Example J | 0.129333 | 0.132667 | 0.11467 | 43.2660 | 33.014300 | 34.47900 |
| Example K | 0.123333 | 0.122667 | 0.11233 | 46.2480 | 33.939000 | 35.80870 |

TABLE II

| | Weight (g) | | | Thickness Change During Compression (Tdiff) (mm) | | |
|---|---|---|---|---|---|---|
| Parameter | 0 Washes | 50 Washes | 125 Washes | 0 Washes | 50 Washes | 125 Washes |
| Example A | 19.9167 | 21.508300 | 21.50000 | 0.36833 | 0.439000 | 0.42667 |
| Example B | 20.4083 | 22.175000 | 22.15000 | 0.39033 | 0.546670 | 0.49033 |
| Example C | 20.5333 | 22.075000 | 22.01670 | 0.43433 | 0.535670 | 0.47667 |
| Example D | 21.0167 | 22.158300 | 22.18330 | 0.24333 | 0.400000 | 0.38133 |
| Example E | 20.0667 | 20.283300 | 20.14170 | 0.29600 | 0.415330 | 0.39067 |
| Example F | 20.6583 | 21.066700 | 21.02500 | 0.34133 | 0.422000 | 0.43167 |
| Example G | 21.4500 | 22.008300 | 22.17500 | 0.30933 | 0.395000 | 0.34967 |
| Example H | 22.9417 | 23.891700 | 22.65830 | 0.33733 | 0.422000 | 0.34400 |
| Example I | 32.0333 | 33.266700 | 32.76670 | 0.28300 | 0.302330 | 0.26033 |
| Example J | 23.3833 | 23.758300 | 23.30000 | 0.34433 | 0.420670 | 0.33800 |
| Example K | 33.7250 | 33.708300 | 34.22500 | 0.30000 | 0.375330 | 0.29500 |

TABLE JJ

| | Shear Hysteresis (2HG05) Warp | | | Shear Hysteresis (2HG05) Filling | | |
|---|---|---|---|---|---|---|
| Parameter | 0 Washes | 50 Washes | 125 Washes | 0 Washes | 50 Washes | 125 Washes |
| Example A | 1.2407 | 1.414670 | 1.21000 | 0.5727 | 0.600670 | 0.45330 |
| Example B | 1.2983 | 1.562330 | 1.30400 | 0.6270 | 0.724670 | 0.59230 |
| Example C | 1.4110 | 1.537670 | 1.34200 | 0.6723 | 0.715000 | 0.62330 |
| Example D | 3.7677 | 1.834670 | 1.61933 | 3.2570 | 1.103000 | 0.76230 |
| Example E | 1.3290 | 1.592670 | 1.48567 | 0.8907 | 0.869000 | 0.72970 |
| Example F | 1.8803 | 0.777670 | 0.80800 | 1.3053 | 0.485330 | 0.44800 |
| Example G | 2.8020 | 2.203000 | 2.17800 | 2.1960 | 1.340330 | 1.33870 |
| Example H | 1.2357 | 2.010330 | 2.24200 | 0.8807 | 1.396330 | 1.38970 |
| Example I | 2.2307 | 4.899670 | 5.02767 | 2.3563 | 4.347000 | 4.49430 |
| Example J | 1.5200 | 2.195670 | 2.43733 | 1.1197 | 1.395670 | 1.46300 |
| Example K | 3.2923 | 6.005000 | 7.25067 | 3.5930 | 5.752000 | 6.50470 |

TABLE KK

| | Shear Hysteresis (2HG25) Warp | | | Shear Hysteresis (2HG25) Filling | | |
|---|---|---|---|---|---|---|
| Parameter | 0 Washes | 50 Washes | 125 Washes | 0 Washes | 50 Washes | 125 Washes |
| Example A | 1.9400 | 1.064700 | 1.79367 | 1.2880 | 2.055000 | 0.90630 |
| Example B | 2.2257 | 1.346300 | 1.91900 | 1.5510 | 2.280300 | 1.07870 |
| Example C | 2.2390 | 1.299000 | 1.98067 | 1.5400 | 2.252700 | 1.19470 |
| Example D | 7.8223 | 2.323300 | 2.60267 | 7.3877 | 3.065300 | 1.66030 |
| Example E | 5.0633 | 1.496000 | 2.09100 | 4.4080 | 2.290700 | 1.29530 |
| Example F | 5.3043 | 0.948700 | 1.27000 | 4.5470 | 1.275300 | 0.81500 |
| Example G | 6.6990 | 2.630000 | 3.39833 | 5.9423 | 3.522000 | 2.57800 |

TABLE KK-continued

| | Shear Hysteresis (2HG25) Warp | | | Shear Hysteresis (2HG25) Filling | | |
|---|---|---|---|---|---|---|
| Parameter | 0 Washes | 50 Washes | 125 Washes | 0 Washes | 50 Washes | 125 Washes |
| Example H | 1.8830 | 2.307000 | 2.98100 | 1.5247 | 2.819700 | 2.15000 |
| Example I | 5.9453 | 8.038700 | 8.10300 | 5.8533 | 8.313000 | 7.87800 |
| Example J | 2.3677 | 2.259700 | 3.24800 | 2.0150 | 3.041000 | 2.26470 |
| Example K | 7.2243 | 9.493700 | 10.82367 | 7.3383 | 9.329000 | 10.35630 |

TABLE LL

| | Shear Hysteresis (2HG50) Warp | | | Shear Hysteresis (2HG50) Filling | | |
|---|---|---|---|---|---|---|
| Parameter | 0 Washes | 50 Washes | 125 Washes | 0 Washes | 50 Washes | 125 Washes |
| Example A | 3.089 | 3.456000 | 3.07830 | 2.560 | 2.344300 | 2.00830 |
| Example B | 3.641 | 3.792000 | 3.19170 | 3.029 | 2.831700 | 2.36200 |
| Example C | 3.614 | 3.845700 | 3.35530 | 3.029 | 2.810300 | 2.53730 |
| Example D | 11.349 | 5.678700 | 4.91330 | 10.753 | 5.091000 | 3.94800 |
| Example E | 10.141 | 3.730700 | 3.42100 | 9.827 | 3.054000 | 2.67300 |
| Example F | 11.387 | 2.752700 | 2.48570 | 10.804 | 2.388300 | 1.95400 |
| Example G | 10.268 | 5.884300 | 5.90670 | 9.731 | 5.192300 | 5.29000 |
| Example H | 3.021 | 4.163300 | 4.07170 | 2.538 | 3.850300 | 3.39070 |
| Example I | 10.130 | 10.638700 | 10.58770 | 9.561 | 10.374000 | 10.31430 |
| Example J | 3.483 | 4.272700 | 4.38070 | 3.275 | 3.603000 | 3.55800 |
| Example K | 12.040 | 11.258300 | 12.62270 | 11.815 | 11.752000 | 12.10130 |

TABLE MM

| | Residual Shear Angle (RG05) Warp | | | Residual Shear Angle (RG05) Filling | | |
|---|---|---|---|---|---|---|
| Parameter | 0 Washes | 50 Washes | 125 Washes | 0 Washes | 50 Washes | 125 Washes |
| Example A | 1.59567 | 2.153700 | 2.05033 | 0.90133 | 1.227000 | 1.04467 |
| Example B | 1.35633 | 2.118000 | 2.12667 | 0.80100 | 1.243670 | 1.21200 |
| Example C | 1.52500 | 2.197000 | 2.05967 | 0.87800 | 1.255670 | 1.19533 |
| Example D | 1.08433 | 1.766000 | 1.87933 | 0.95733 | 1.099670 | 1.04733 |
| Example E | 0.54300 | 2.304000 | 2.34333 | 0.40700 | 1.421000 | 1.27533 |
| Example F | 0.86633 | 1.524700 | 1.62367 | 0.70667 | 1.033670 | 1.10933 |
| Example G | 0.85833 | 2.105000 | 2.03200 | 0.81133 | 1.274000 | 1.32533 |
| Example H | 1.64633 | 2.407300 | 2.68900 | 1.32633 | 1.686670 | 1.89500 |
| Example I | 0.81667 | 1.773700 | 1.95267 | 0.87533 | 1.567670 | 1.68700 |
| Example J | 1.69000 | 2.608700 | 2.80967 | 1.36700 | 1.812000 | 1.94000 |
| Example K | 1.10700 | 2.067700 | 2.21867 | 1.24100 | 1.857330 | 1.96800 |

TABLE NN

| | Residual Shear Angle (RG25) Warp | | | Residual Shear Angle (RG25) Filling | | |
|---|---|---|---|---|---|---|
| Parameter | 0 Washes | 50 Washes | 125 Washes | 0 Washes | 50 Washes | 125 Washes |
| Example A | 2.49667 | 3.127330 | 3.03333 | 2.02633 | 2.173330 | 2.08567 |
| Example B | 2.32200 | 3.088330 | 3.13100 | 1.98033 | 2.309330 | 2.20200 |
| Example C | 2.41933 | 3.216330 | 3.03933 | 2.00633 | 2.279670 | 2.28933 |
| Example D | 2.25600 | 2.950670 | 3.01767 | 2.17667 | 2.316000 | 2.27667 |
| Example E | 2.07300 | 3.311670 | 3.30033 | 2.00333 | 2.437000 | 2.26967 |
| Example F | 2.37233 | 2.496330 | 2.55000 | 2.24533 | 2.019330 | 2.02133 |
| Example G | 2.28367 | 3.214000 | 3.17067 | 2.19267 | 2.501000 | 2.55067 |
| Example H | 2.49833 | 3.367670 | 3.57267 | 2.29667 | 2.784670 | 2.93067 |

TABLE NN-continued

| | Residual Shear Angle (RG25) Warp | | | Residual Shear Angle (RG25) Filling | | |
|---|---|---|---|---|---|---|
| Parameter | 0 Washes | 50 Washes | 125 Washes | 0 Washes | 50 Washes | 125 Washes |
| Example I | 2.17433 | 3.009000 | 3.14733 | 2.17433 | 2.898670 | 2.95833 |
| Example J | 2.62300 | 3.606670 | 3.74500 | 2.45600 | 2.932670 | 2.99867 |
| Example K | 2.41033 | 3.212000 | 3.31233 | 2.52000 | 3.066330 | 3.13333 |

TABLE OO

| | Residual Shear Angle (RG50) Warp | | | Residual Shear Angle (RG50) Filling | | |
|---|---|---|---|---|---|---|
| Parameter | 0 Washes | 50 Washes | 125 Washes | 0 Washes | 50 Washes | 125 Washes |
| Example A | 3.9760 | 5.267000 | 5.21770 | 4.0303 | 4.785300 | 4.61900 |
| Example B | 3.7973 | 5.134700 | 5.21070 | 3.8673 | 4.859700 | 4.82470 |
| Example C | 3.9040 | 5.488000 | 5.14600 | 3.9453 | 4.934000 | 4.86870 |
| Example D | 3.2743 | 5.466300 | 5.69530 | 3.1717 | 5.089700 | 5.41270 |
| Example E | 4.1503 | 5.392300 | 5.40700 | 4.4680 | 4.978000 | 4.70430 |
| Example F | 5.1237 | 5.384700 | 4.99200 | 5.3377 | 5.084700 | 4.85630 |
| Example G | 3.5250 | 5.367300 | 5.51200 | 3.6003 | 4.946000 | 5.23730 |
| Example H | 4.0087 | 4.977000 | 4.87930 | 3.8227 | 4.648700 | 4.62200 |
| Example I | 3.7033 | 3.850300 | 4.11200 | 3.5537 | 3.740700 | 3.87700 |
| Example J | 3.8647 | 5.069000 | 5.05130 | 3.9990 | 4.672700 | 4.70970 |
| Example K | 4.0127 | 3.876300 | 3.86300 | 4.0720 | 3.797300 | 3.66170 |

TABLE PP

| | Mean Deviation of Coefficient of Friction (MMD) Warp | | | Mean Deviation of Coefficient of Friction (MMD) Filling | | |
|---|---|---|---|---|---|---|
| Parameter | 0 Washes | 50 Washes | 125 Washes | 0 Washes | 50 Washes | 125 Washes |
| Example A | 0.021333 | 0.026667 | 0.02867 | 0.024000 | 0.020667 | 0.02367 |
| Example B | 0.024000 | 0.024000 | 0.02400 | 0.027667 | 0.023667 | 0.02500 |
| Example C | 0.024333 | 0.023667 | 0.02433 | 0.025000 | 0.023333 | 0.02300 |
| Example D | 0.039667 | 0.071667 | 0.07433 | 0.038667 | 0.032333 | 0.02733 |
| Example E | 0.024333 | 0.019333 | 0.02267 | 0.029000 | 0.027000 | 0.02600 |
| Example F | 0.035000 | 0.021667 | 0.02833 | 0.034667 | 0.032333 | 0.02767 |
| Example G | 0.056667 | 0.076667 | 0.09700 | 0.038000 | 0.031333 | 0.03100 |
| Example H | 0.014333 | 0.015333 | 0.01400 | 0.018333 | 0.021333 | 0.02067 |
| Example I | 0.016000 | 0.012000 | 0.01433 | 0.022000 | 0.018333 | 0.01767 |
| Example J | 0.016000 | 0.016333 | 0.01833 | 0.019333 | 0.022333 | 0.02500 |
| Example K | 0.012667 | 0.012333 | 0.01133 | 0.022333 | 0.018000 | 0.01767 |

TABLE QQ

| | Surface Roughness (SMD) Warp | | | Surface Roughness (SMD) Filling | | |
|---|---|---|---|---|---|---|
| Parameter | 0 Washes | 50 Washes | 125 Washes | 0 Washes | 50 Washes | 125 Washes |
| Example A | 12.6457 | 12.194700 | 11.75230 | 6.2930 | 6.042700 | 5.76130 |
| Example B | 9.4970 | 9.081000 | 8.73870 | 5.8047 | 5.950000 | 6.37500 |
| Example C | 9.9760 | 9.096000 | 9.45800 | 5.3733 | 5.618300 | 6.00500 |
| Example D | 12.4050 | 11.195000 | 10.84230 | 7.4990 | 7.373300 | 6.21030 |
| Example E | 12.8140 | 12.872000 | 12.50500 | 7.1800 | 7.856000 | 7.74670 |
| Example F | 10.6303 | 10.471300 | 10.46900 | 7.6433 | 6.938700 | 7.01330 |
| Example G | 10.6733 | 10.235700 | 10.59570 | 7.1230 | 6.476000 | 6.66370 |
| Example H | 2.3677 | 2.738300 | 2.33400 | 4.4337 | 5.433000 | 4.86400 |

TABLE QQ-continued

| | Surface Roughness (SMD) Warp | | | Surface Roughness (SMD) Filling | | |
|---|---|---|---|---|---|---|
| Parameter | 0 Washes | 50 Washes | 125 Washes | 0 Washes | 50 Washes | 125 Washes |
| Example I | 2.5200 | 1.987300 | 1.98030 | 5.3827 | 4.622000 | 4.18800 |
| Example J | 3.8980 | 2.532000 | 2.61830 | 5.0787 | 5.642000 | 4.88630 |
| Example K | 2.5487 | 2.035700 | 1.85130 | 6.0113 | 4.168700 | 4.01170 |

TABLE RR

| | Linearity of Extension (LT) Warp | | | Linearity of Extension (LT) Filling | | |
|---|---|---|---|---|---|---|
| Parameter | 0 Washes | 50 Washes | 125 Washes | 0 Washes | 50 Washes | 125 Washes |
| Example A | 0.705 | 0.580670 | 0.58800 | 0.730 | 0.583000 | 0.62600 |
| Example B | 0.679 | 0.606330 | 0.61100 | 0.731 | 0.595330 | 0.63433 |
| Example C | 0.736 | 0.590670 | 0.62233 | 0.666 | 0.583670 | 0.64700 |
| Example D | 0.700 | 0.613330 | 0.61033 | 0.679 | 0.613670 | 0.65800 |
| Example E | 0.813 | 0.584000 | 0.64300 | 0.728 | 0.593330 | 0.70500 |
| Example F | 0.703 | 0.637670 | 0.63500 | 0.674 | 0.608330 | 0.62533 |
| Example G | 0.733 | 0.633670 | 0.66667 | 0.753 | 0.647000 | 0.61267 |
| Example H | 0.588 | 0.598670 | 0.60900 | 0.622 | 0.601670 | 0.60567 |
| Example I | 0.672 | 0.682000 | 0.70133 | 0.807 | 0.693000 | 0.71867 |
| Example J | 0.675 | 0.601670 | 0.64333 | 0.599 | 0.603000 | 0.61433 |
| Example K | 0.727 | 0.677000 | 0.69700 | 0.748 | 0.685330 | 0.75567 |

TABLE SS

| | Tensile Resiliency (RT) Warp | | | Tensile Resiliency (RT) Filling | | |
|---|---|---|---|---|---|---|
| Parameter | 0 Washes | 50 Washes | 125 Washes | 0 Washes | 50 Washes | 125 Washes |
| Example A | 51.854 | 49.300700 | 48.44500 | 57.483 | 56.347700 | 55.96100 |
| Example B | 52.120 | 48.758000 | 48.70300 | 57.281 | 54.911300 | 54.25900 |
| Example C | 51.531 | 48.273300 | 47.83300 | 57.200 | 53.761700 | 53.68600 |
| Example D | 55.109 | 48.086000 | 49.20500 | 58.795 | 54.777000 | 55.18900 |
| Example E | 52.802 | 49.159700 | 47.17600 | 58.120 | 55.645300 | 56.80200 |
| Example F | 42.334 | 44.300700 | 46.11400 | 50.833 | 51.461000 | 51.80000 |
| Example G | 48.799 | 47.513000 | 47.20500 | 58.244 | 54.983000 | 54.36800 |
| Example H | 43.341 | 38.401700 | 39.45900 | 50.383 | 41.756300 | 37.85300 |
| Example I | 42.005 | 36.987300 | 33.71800 | 51.343 | 40.68700 | 39.71600 |
| Example J | 37.993 | 37.798300 | 36.32200 | 48.606 | 40.566300 | 37.97300 |
| Example K | 40.292 | 35.886700 | 32.63800 | 57.588 | 42.283300 | 39.91200 |

In addition, the hand improvements were achieved while the strength of the fabric was maintained, and in fact, some strength measurements were improved. In addition, the fabrics of the invention had superior ATPV, lower char length, better warp fray, superior drape and bending modulus, better wicking and soil release, and better combination of comfort characteristics with a particular level of FR.

Stated differently, the fabrics had comfort levels approximating those of cotton, while at durability levels approximating those of fabrics made from inherently FR fabrics. Furthermore, because of the improved soil release characteristics and reduced soil retention, it is expected that the fabrics would be less likely to hold onto oily stains that might otherwise adversely impact the FR potential of the fabrics.

In addition, the Handle-o-meter measurements on the unwashed fabrics of the present invention are substantially better than those of the conventional fabrics, which is indicative of the superior drape (and thus perceived comfort) that they possess.

The fabrics of the present invention have utility in a variety of end uses, including but not limited to protective apparel, industrial work apparel (i.e. that designed to be worn in an industrial environment and laundered under industrial wash conditions), military apparel, transportation vehicle interiors (including but not limited to aviation, boat, car, bus, train, RV etc. interiors), industrial fire barriers, home and office furnishings, office panels, and virtually anywhere that FR protection would be of advantage.

In the specification there has been set forth a preferred embodiment of the invention, and although specific terms are employed, they are used in a generic and descriptive sense only and not for purpose of limitation, the scope of the invention being defined in the claims.

We claim:

1. A method of making a soft fabric of inherently flame resistant fibers, comprising the steps of:

providing a fabric comprising yarns having at least two plies, wherein said yarns comprises inherently flame resistant fibers and at least some of the fibers are in staple form;

impinging said fabric with a fluid such that at least a portion of the plies of at least some of said yarns are separated from each other;

applying an ethoxylated polyamide and an ethoxylated polyester to said fabric, wherein said fabric comprises about 0.25–5% owf of ethoxylated polyamide and about 0.25–5% owf of ethoxylated polyester.

2. A method according to claim 1, wherein said step of impinging said fabric with a fluid comprises impinging said fabric with a liquid.

3. A method according to claim 1, wherein said fabric comprises a woven fabric.

4. A method according to claim 1, wherein said fabric comprises at least about 90% inherently flame resistant fibers.

5. The method according to claim 1, wherein said step of impinging said fabric with a fluid also causes fibers forming said individual plies to become entangled with the fibers of other individual plies.

6. The method according to claim 1, wherein said step of impinging the fabric with a fluid causes the formation of a plurality of fiber tangles on at least one surface of the fabric, and said fiber tangles comprise fibers that are substantially intact and undamaged.

7. The method according to claim 1, wherein said soft fabric has a soil release rating of about 2.5 or greater when soiled at 0 washes and tested after one wash, according to AATCC 130-1995 Test Method.

8. The method according to claim 1, wherein said soft fabric has a soil release rating of about 3.0 or greater when soiled at 0 washes and tested after 1 wash, according to AATCC 130-1995 Test Method.

9. The method according to claim 1, wherein said soft fabric has a Drop Disappearance of about 2 seconds or less.

10. A method according to claim 1, wherein said soft fabric has a soil release rating of about 3.5 or greater for corn oil when tested according to AATCC Test Method 130-95 when soiled at 48 washes and tested after 49 washes.

11. The method according to claim 1, wherein said soft fabric has a weight of about 2 to about l2 oz/sq yd.

12. The method according to claim 1, further comprising drying said fabric at a temperature of between 325 and 425° F. after applying an ethoxylated polyamide and an ethoxylated polyester to said fabric.

13. A method of making a soft fabric of inherently flame resistant fibers, comprising the steps of:

providing a woven fabric comprising yarns having at least two plies, wherein said yarns comprise at least about 90% inherently flame resistant fibers and at least some of the fibers are in staple form;

impinging said fabric with a liquid such that at least a portion of the plies of at least some of said yarns are separated from each other;

applying an ethoxylated polyamide and an ethoxylated polyester to said fabric;

drying said fabric at a temperature of between 325 and 425° F.;

wherein said fabric comprises about 0.25–5% owf of ethoxylated polyamide and about 0.25–5% owf of ethoxylated polyester, and wherein the soft formed has fabric has a soil release rating of about 2.5 or greater when soiled at 0 washes and tested after one wash, according to AATCC 130-1995 Test Method and a soil release rating of about 3.5 or greater for corn oil when tested according to AATCC Test Method 130-95 when soiled at 48 washes and tested after 49 washes.

* * * * *